US005794542A

United States Patent [19]

Besaw

[11] Patent Number: 5,794,542

[45] Date of Patent: Aug. 18, 1998

[54] CORRUGATED COLLAPSIBLE CONTAINER PACK

[75] Inventor: Larry G. Besaw, Jasper, Ind.

[73] Assignee: The Servants, Inc., Jasper, Ind.

[21] Appl. No.: 760,225

[22] Filed: Dec. 4, 1996

[51] Int. Cl.[6] ..... B65D 19/00

[52] U.S. Cl. ..... 108/51.3; 108/56.1; 206/600

[58] Field of Search ..... 108/51.3, 51.1, 108/56.1, 56.3, 55.1, 55.5, 51.11; 206/386, 600

[56] References Cited

U.S. PATENT DOCUMENTS

| | | | |
|---|---|---|---|
| 2,691,500 | 10/1954 | Baumann . | |
| 2,996,276 | 8/1961 | Sorensen et al. . | |
| 3,055,624 | 7/1962 | Wilson . | |
| 3,071,045 | 1/1963 | Budd . | |
| 3,272,158 | 9/1966 | Barnum . | |
| 3,407,758 | 10/1968 | Simkins . | |
| 3,425,367 | 2/1969 | Oraves . | |
| 3,480,196 | 11/1969 | De Dimas | 108/51.3 X |
| 3,557,719 | 1/1971 | Gielas . | |
| 3,587,479 | 6/1971 | Geschwendor . | |
| 3,995,736 | 12/1976 | Lawson et al. | 108/51.3 X |
| 4,015,544 | 4/1977 | Szatkowski . | |
| 4,085,847 | 4/1978 | Jacalone | 108/51.3 X |
| 4,090,659 | 5/1978 | Galmiche et al. | 108/51.3 X |
| 4,228,744 | 10/1980 | Moore . | |
| 4,372,221 | 2/1983 | White | 108/51.3 |
| 4,487,136 | 12/1984 | Beckway . | |
| 4,697,699 | 10/1987 | Schneider . | |
| 4,717,025 | 1/1988 | Maurer | 108/51.3 X |
| 4,850,284 | 7/1989 | DeGroot et al. . | |
| 5,129,329 | 7/1992 | Clasen . | |
| 5,184,558 | 2/1993 | Wozniacki . | |
| 5,195,440 | 3/1993 | Gottlieb . | |
| 5,285,732 | 2/1994 | Gottlieb . | |
| 5,327,839 | 7/1994 | Herring et al. . | |
| 5,329,861 | 7/1994 | McCarthy . | |
| 5,350,066 | 9/1994 | Mendoza et al. | 108/51.3 X |
| 5,370,062 | 12/1994 | Johnston et al. . | |
| 5,377,600 | 1/1995 | Speese et al. . | |
| 5,383,409 | 1/1995 | Hayakawa . | |
| 5,441,154 | 8/1995 | Youell, III | 108/51.3 X |
| 5,535,668 | 7/1996 | Besaw . | |
| 5,562,048 | 10/1996 | Gottlieb | 108/51.3 |

FOREIGN PATENT DOCUMENTS

| | | | |
|---|---|---|---|
| 2676711 | 11/1992 | France | 108/51.3 |
| 313777 | 8/1969 | Sweden | 108/51.3 |
| 697232 | 9/1953 | United Kingdom . | |

*Primary Examiner*—Jose V. Chen
*Attorney, Agent, or Firm*—David W. Carrithers

[57] ABSTRACT

This invention relates to a lightweight, high strength disposable or recyclable corrugated collapsible container pack providing a compact collapsed shipping container including an integral corrugated pallet and providing top or side access in the erected state.

Corrugated leg wrap supports utilizing a sheet of corrugated material having a plurality of score lines folded inwardly forming a generally rectangular conduit support member are used in combination with at least one corrugated sheet to form a corrugated pallet. Within the hollow conduit of the leg wrap supports, individual support members are formed from one or more layers of a narrow strip of corrugated material having a plurality of scores cut therein along the surface of one side for bending the strip into a generally square configuration. The flutes of the corrugated material comprising the support member and opposing panel support legs are oriented in the vertical plane to maximize the strength to weight ratio.

1 Claim, 28 Drawing Sheets

172

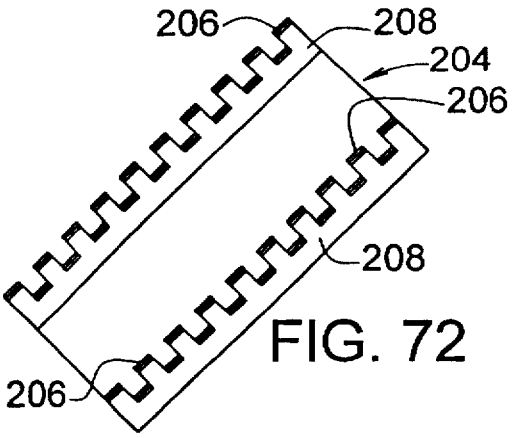
FIG. 72
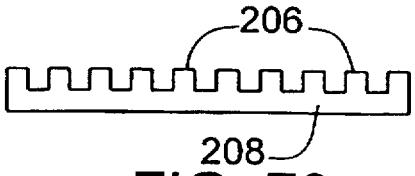
FIG. 73
FIG. 74
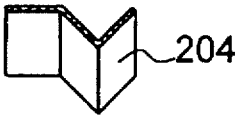
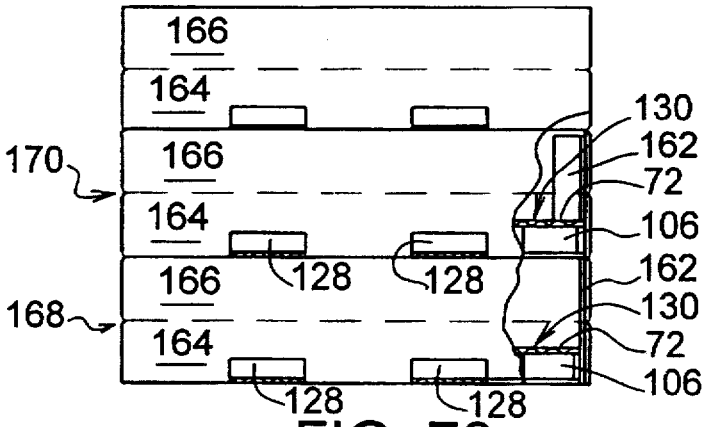
FIG. 76
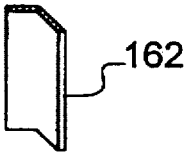
FIG. 75
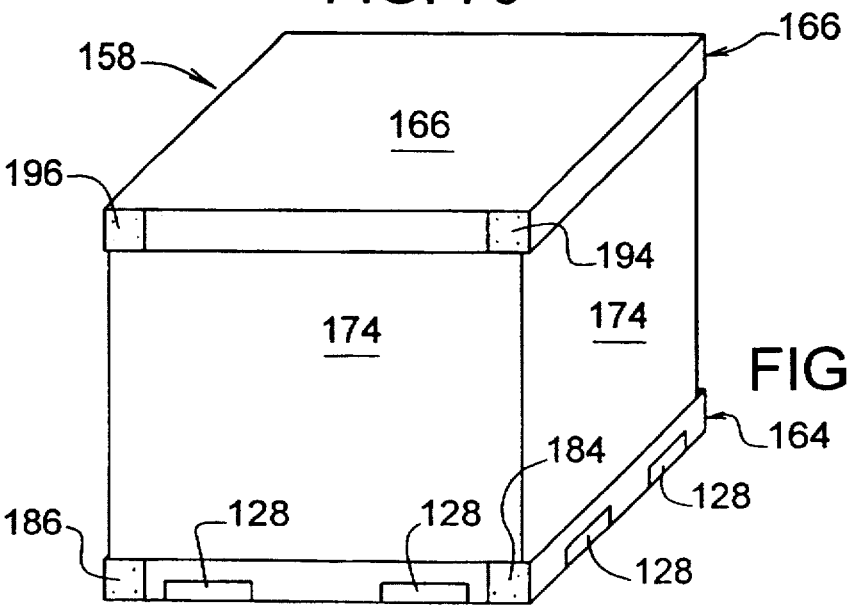
FIG. 77

CORRUGATED COLLAPSIBLE CONTAINER PACK

BACKGROUND OF THE INVENTION

This invention relates to a lightweight, high strength disposable or recyclable corrugated collapsible container pack providing a compact collapsed shipping container including an integral corrugated pallet and providing top or side access in the erected state.

Corrugated shipping containers are used as a method of handling materials in large quantities. The containers, are usually formed as large boxes typically comprise sidewalls, a bottom defining a flat surface for supporting materials packed therein, and a top sheet of cover. The shipping container is usually placed upon a wood pallet to provide a spacing and support means to allow for sufficient distance from the floor to permit the tines of the lift truck forks to be inserted under the pallet and shipping container thereon to support the load so it can be moved from place to place. Pallets used for this purpose are fabricated from wood, metal, plastic, or combinations thereof. Conventional pallets fabricated from these materials are expensive to make and use due to the cost of the materials, cost of construction, and cost of disposal. Usually these conventional types of pallets have to be returned after the shipment to the shipper for reuse or the pallets had to be disposed of in a proper manner. Deposal of the conventional wood and nail pallets is a problem after exposure to chemical or biochemical materials which contaminate the pallet in that not all of the pallet materials of construction are destructible by incineration and often must be disposed in a hazardous waste landfill which is inconvenient and expensive.

SUMMARY OF THE INVENTION

The lightweight, high strength disposable or recyclable corrugated collapsible container pack providing a compact collapsed shipping container providing top or side access in the erected state and including an integral corrugated pallet which can be erected without tools to provide a large bulk container which can be moved by a forklift and stacked for transporting or storage.

The present invention eliminates several of the disadvantages associated with the use of conventional wood pallets and provides for an integral internal pallet incorporated within the corrugated collapsible container pack. The collapsible container pack and integral pallet are comprised of inexpensive materials such as corrugated board or paperboard and an adhesive such as glue all of which may be generally recognized as safe, "GRAS", by the Food and Drug Administration, "FDA", so that they are recyclable, disposable in sanitary landfills, and inexpensive to manufacture. The corrugated collapsible container pack and integral pallet of the present invention is also easy to dispose of in case of contamination due to product spills or damage because all of the materials of construction are biodegradable and/or can be incinerated without further disassembly, yet they are reusable for many purposes. The corrugated collapsible container pack and pallet are light in weight and have great structural strength. Thus, the corrugated collapsible container pack and pallet of the instant invention are especially suited for commercial use of by consumers especially for applications such as moving goods whereby smaller conventional collapsed bags and/or boxes can be pre-stored within the corrugated collapsible container pack. The smaller bags and boxes may then be filled and placed in the corrugated collapsible container pack for shipping by truck or other means of transportation, thereby providing a container unit having an integral pallet which has the strength for containing the goods, and is designed to facilitate stacking with a fork lift for transporting and storage purposes.

Although it is contemplated that the collapsible container pack body of the present invention could be used with conventional pallets fabricated from corrugated material, wood, or plastic, the preferred embodiment of the present invention utilizes corrugated pallets described and claimed in applicant's U.S. Pat. No. 5,535,668 and U.S. patent application Ser. Nos. 08/218,111 and 08/358,145 hereby incorporated by reference.

One embodiment of the corrugated pallet of the present invention comprises a support surface consisting of at least one flat sheet of single or double ply corrugated material supported by a plurality of supporting members or legs formed from corrugated material. In one preferred embodiment, "I" shaped perforations are formed and interconnected with straight score lines along a template formed in the flat sheet of material. Aligning and pressing the support members through the primary support sheet detaches the cut portions of the panels integrally formed therein which biases the panels forming flaps extending against opposite sides of the support members. Coating of the template prior to insertion of the support members through the scored panel formed in the primary support sheet provides a means of simultaneously applying an adhesive between the panels and the support members.

Another embodiment of the corrugated pallet of the present invention entails a corrugated pallet comprising a primary support sheet surface of flat corrugated material having a plurality of opposing panels formed therein. The opposing panels are hingeably connected to the primary support sheet. Each of the opposing panels are folded downward normal to the surface of the primary support panel to define a supporting leg. A support member is fastened in between or around each of the support legs, wherein the support member comprises a strip of corrugated material having a plurality of scores cut therein for bending the strip into a square or block complementary sized for insertion into or around the supporting legs, and extending the length of the supporting legs. Moreover, a means such as an adhesive is provided for fastening the support members to the support legs providing multiple layers of single or multiple ply corrugated material for supporting the load bearing primary support panel.

The preferred embodiment of the present invention consists of a corrugated leg-wrap pallet comprising a support surface comprising at least one multi-ply corrugated sheet, and at least two leg-wrap support members secured to the bottom of the support surface. The leg-wrap support members comprise a multi-ply corrugated sheet having a plurality of spaced apart parallel score lines formed therein with the sheet being folded inwardly forming creases along said score lines and at least five panel sections thereinbetween forming a generally rectangular shaped conduit having at least two of the panel sections overlapping and secured together. Moreover, the leg-wrap support has at least two spaced apart and aligned transverse slots formed through the sides of the leg-wrap support normal to the longitudinal axis of the leg-wrap support complementary sized and shaped and adapted to accommodate the tines of a lift truck. A plurality of generally square corrugated support members are disposed inside of the leg-wrap support and positioned between the slots for additional structural support.

The corrugated leg-wrap pallet may have a support surface extended in length and having a pair of spaced apart parallel score lines forming an inner side panel and outer side panel on each side of the support surface. The inner side panel and the outer side panel may be folded inwardly and wrapped around the leg-wrap support members forming side rails supports extending along each side of the support surface.

The corrugated collapsible container pack and integral pallet is fabricated by placing one of the aforementioned corrugated pallets into a corrugated tray. The corrugated tray is prepared by cutting and scoring a corrugated sheet having cutouts at predetermined position to accommodate the tines of a fork lift extending therethrough and in under the corrugated pallet. The edges of the tray are folding the edges upwardly forming a lip and attaching the corners of the edges together with means for attachment such as glue, staples, hook and loop fasteners, or combinations thereof. The sides of the collapsible container pack are formed from a pair of opposing die cut and scored corrugated sheets having slots cut therefrom to match the position of the openings formed in the corrugated pallet and tray edges. The sides could be formed in a single sheet; however, as opposed to conventional shipping containers, at least one of the sides is left open to accommodate a side panel which is utilized as a removable door during utilization of the collapsible container pack to provide the user with a means to access the collapsible container pack at times during storage when material is stacked upon it. An important feature of the present invention involves the use of corner reinforcement members which supported the corrugated collapsible container pack at a selected height during shipment and can be utilized as internal support members within the container pack during the erected state, or provide an external support to cushion tie-bands used to hold the container pack together during shipping.

Accordingly, it is a principal object of the present invention to provide a disposable and recyclable corrugated collapsible container pack and integral pallet of the lowest possible cost while maximizing its strength and durability.

It is an object of the present invention to provide a disposable collapsible container pack and integral pallet capable of manufacture solely from lightweight sheet material such as corrugated board and an adhesive.

It is an object of the present invention to provide a corrugated pallet utilizing corrugated leg wrap support members having corrugated support members therein to support the corrugated collapsible container pack high enough above a surface to accommodate the tines of a fork lift.

It is another object of the present invention to construct the pallet with the supporting members being positioned to dissipate the weight of the load on the pallet evenly.

It is another object to construct the pallet so that it will sustain loads to which it is subjected and not fold or bend sideways in movement or shipment.

It is another object of the present invention to provide a corrugated collapsible container pallet which is less than ½ its erected height when collapsed and which provides sufficient structural support to maintain structural integrity upon being stacked for shipment or storage.

It is yet another object of the present invention to provide a corrugated collapsible having at least one removable side panel which can be removed with the pallet in the stacked position providing access to the goods stored therein.

It is yet another object of the present invention to provide a vertical support member having a selected length to utilize in the corrugated collapsible container pack during shipment in the collapsed state to protect the goods inside, whereby the vertical support member may be used internally for support or externally as a protection, support, and cushioning means when used in combination with binding ties.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 72 is a perspective view of a corrugated separator sheet which may be utilized in the corrugated collapsible container pack;

FIG. 73 is a side view of a corrugated separator sheet which may be utilized in the corrugated collapsible container pack;

FIG. 74 is a perspective view of a corrugated spacer sheet which may be utilized in the corrugated collapsible container pack;

FIG. 75 is another embodiment of a perspective view of a corrugated spacer sheet which may be utilized in the corrugated collapsible container pack;

FIG. 76 is a front view of a stack of collapsed corrugated collapsible container packs showing a partial cutaway view to reveal the use of the vertical support resting on the surface of a leg wrap support pallet and recesses adapted for insertion of the tines of a fork lift;

FIG. 77 is a perspective view of an erected corrugated collapsible container pack;

SPECIFICATION

The instant invention is a corrugated collapsible container pack and integral pallet fabricated from low weight, high strength disposable or recyclable corrugated material providing a compact collapsed shipping container including an integral corrugated pallet and providing top or side access in the erected state.

The preferred embodiment utilizes corrugated leg wrap supports having a sheet of corrugated material having a plurality of score lines folded inwardly forming a generally rectangular conduit support member are used in combination with at least one corrugated sheet to form a corrugated pallet. Within the hollow conduit of the leg wrap supports, individual support members are formed from one or more layers of a narrow strip of corrugated material having a plurality of scores cut therein along the surface of one side for bending the strip into a generally square configuration. The flutes of the corrugated material comprising the support member and opposing panel support legs are oriented in the vertical plane to maximize the strength to weight ratio.

It is contemplated that the instant invention could be fabricated from plastic material as well as other types of paperboard.

The various embodiments of the corrugated pallet utilized in the present invention shall be described in detail and then described in combination with the container features.

CORRUGATED PALLET

The corrugated pallet 10 of the present invention is designed using one of more layers of single or multiple plies of semi-rigid material such as corrugated board, fiberboard, corrugated plastic sheets for the fabrication of inexpensive disposable skids. It is contemplated that the sheet material may be coated with oil, wax, a surfactant, or a polymer film to repel moisture. The semi-rigid material is typically cut into sheets and strips of material fastened together preferably with an adhesive, such as a glue, or by staples, rivets, or other fastening means. The sheet material is fed into a die which makes the cuts and score lines for the number of foldable panel legs required for the load capacity of a particular pallet.

Figure 1:
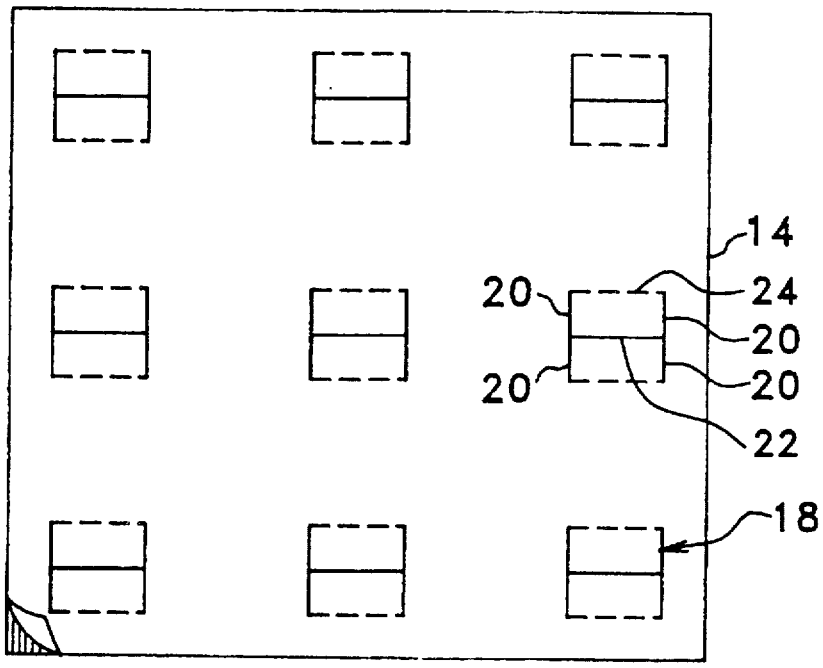
FIG. 1 is a plan top view showing the perforations cut through and scores lines formed in the surface of a corrugated sheet of material forming a template in the primary support sheet of the present invention.
Figure 2:
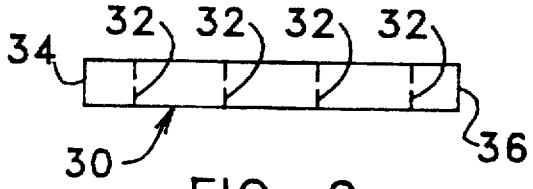
FIG. 2 is a front plan view showing a strip of corrugated material having a plurality of perforations and scores therein for foldably forming a support member of the present invention.
Figure 3:
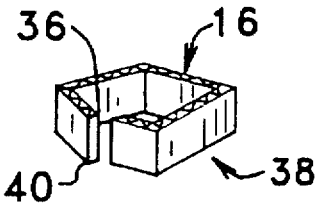
FIG. 3 is an elevational perspective view of a support member of the present invention.

As shown in FIGS. 1–9, one preferred embodiment of the present invention comprises a single sheet corrugated pallet 12 having at least one first primary support sheet 14 comprising a single sheet of fluted single, double, triple, quadruple, or multiple plies of corrugated board supported by a plurality of support leg members 16. FIG. 1 shows the primary support sheet 14 of one preferred embodiment including a plurality of foldable panels 18 each one being defined by a pair of parallel cut lines 20 on each side opposite one another and intersecting with a center cut line 22 in the general shape of an "I". Moreover, perforations forming score lines 24 are formed in the primary support sheet 14 intersecting the distal ends of each of the cut lines 20 for hingeably joining the generally rectangular or square panels 18 formed therein to the primary support sheet 14.

The support members 16 are likewise made of strips 30 of double fluted corrugated board having four score lines 32 spaced apart from one another normal to the longitudinal axis. The strips 30 are folded into square or rectangular formation so that the distal ends 34 and 36 respectfully join at a point 40 between the corners, preferably in the center section of the square support member 16. The wall thickness and size of the support members 38 vary depending upon the weight of the load supported and the number of support members 16 utilized.

Figure 4:
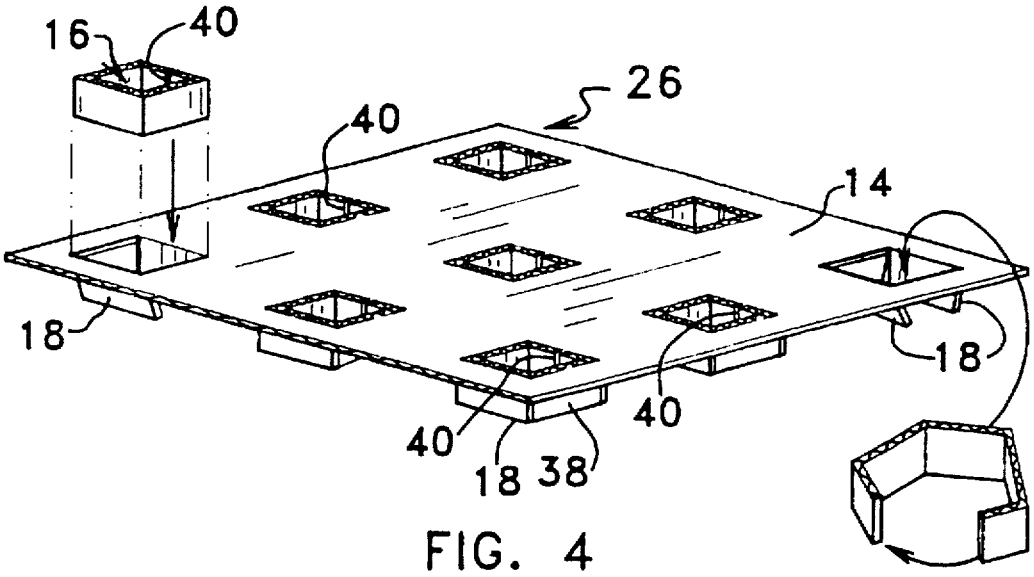
FIG. 4 is an elevational perspective view showing insertion of support members through the template cut and scored in the primary support sheet pushing the portion of the primary support sheet along the center-cut downward and simultaneously bending the primary support sheet along the crease scored therein.
Figure 5:
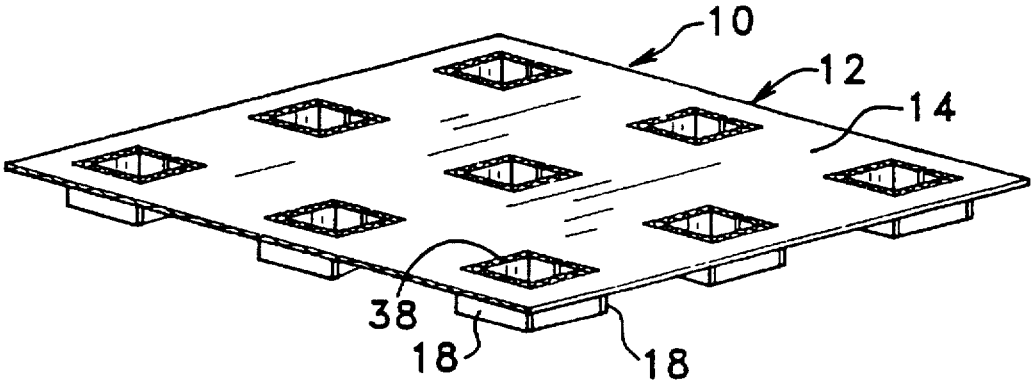
FIG. 5 is an elevational perspective view showing the single sheet corrugated pallet of the present invention.

As best illustrated in FIG. 4, exertion of pressure upon the surface of the panel template by insertion of a support member 16 forces the foldable panels 18 downward opposite one another and normal to the surface of the primary support sheet 14 forming a pair of opposing panel legs 26. The support members 16 are rotated and positioned between the panel legs 26 so that the point 40 of junction of the distal ends 34, 36 of the support member 16 are adjacent and contiguous with one side of one of the foldable panels 18.

Figure 23:
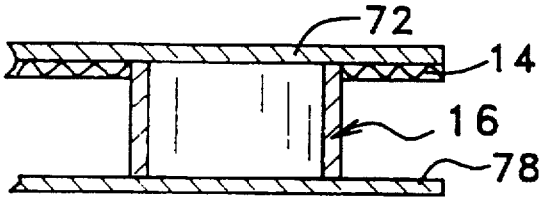
FIG. 23 is a sectional view taken along lines 23—23 showing the sides of the support member disposed between a pair of foldable panels.
Figure 24:
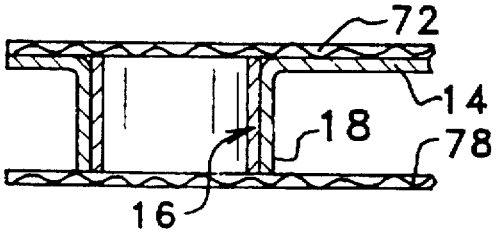
FIG. 24 is a sectional view taken along lines 24—24 showing the sides of the support member between the sides of the primary support sheet panels.
Figure 29:
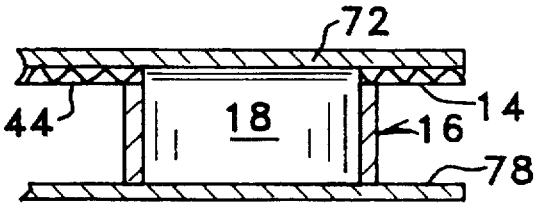
FIG. 29 is a sectional view taken along lines 29—29 showing the sides of the support member around the panels.
Figure 30:
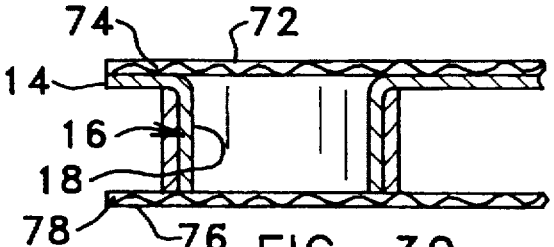
FIG. 30 is a sectional view taken along lines 30—30 showing the sides of the support member surrounding the sides of the primary support sheet panels.

The support members 16 may be attached to the panel legs 26 by various fastening means such as by staples, rivets, tape, interlocking tabs, or clips; however, in the preferred embodiment, a glue, preferably a water soluble glue, is used as an adhesive to hold the opposing panel legs 26 securely to the support members 16. In the preferred embodiment, the support leg members 16 are sized and shaped to provide a complementary fit with the panel legs 26. Insertion of the support members 16 within the panel legs 26 provides a reinforcing structure in that the depth of the support member 16 extends the length of the panel legs 26 and the thickness of the primary support panel 14 in order to provide optimal support for the load such as best shown in FIGS. 23–24. Surrounding or wrapping the panel legs 26 with a support member 16 provides a reinforcing structure in that the depth of the support members 16 extends the length of the panel legs 26 less the thickness of the primary support panel 14, so that the top edge of the support members 16 support the bottom surface of the primary support panel 14 around the opening formed by the panels 18 to provide optimal support for the load and alleviate stress at the junction of the panel legs 26 to the primary support panel 14 such as is shown best in FIGS. 29–30. However, it is contemplated that the support members 16 may be of a depth of either more or less than that of the primary support panel providing lateral side to side support and providing an edge or sidewall between the panel legs 26 and the supporting member to facilitate stacking of the corrugated pallets 10 one upon another such as is shown in FIGS. 37–40.

Figure 6:
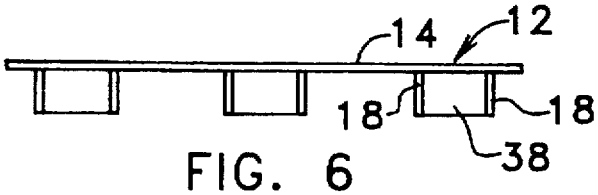
FIG. 6 is an elevational side view of the single sheet corrugated pallet showing the edges of the foldable panels comprising the support legs.
Figure 7:
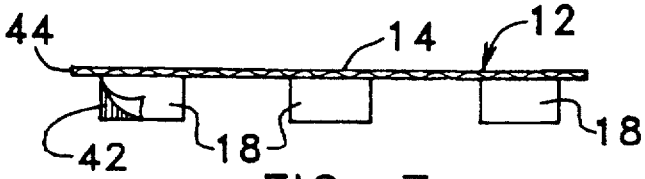
FIG. 7 is an elevational end view of the single sheet corrugated pallet of FIG. 1 showing the orientation of the panel flutes in alignment with the flutes in the primary support sheet.

Moreover, as shown in FIG. 4, an adhesive such as water soluble or biodegradable glue is applied to the template surface of the primary support sheet 14 before insertion of the support member 16. Insertion of the support members 16 through the primary support panel 14 distributes the adhesive onto the surface of the support members 16 as the support members 16 are pushed through the marked template. FIG. 6 shows a side view of a single sheet corrugated pallet 12 showing the leg panels 16 secured to opposing sides of a support member 38. FIG. 7 shows an end view of a single sheet corrugated pallet wherein the flutes 42 of the foldable panels 18 are aligned with the flutes 44 of the primary support sheet 14 so that the foldable panel flutes 42 extend normal to the supporting surface.

Figure 8:
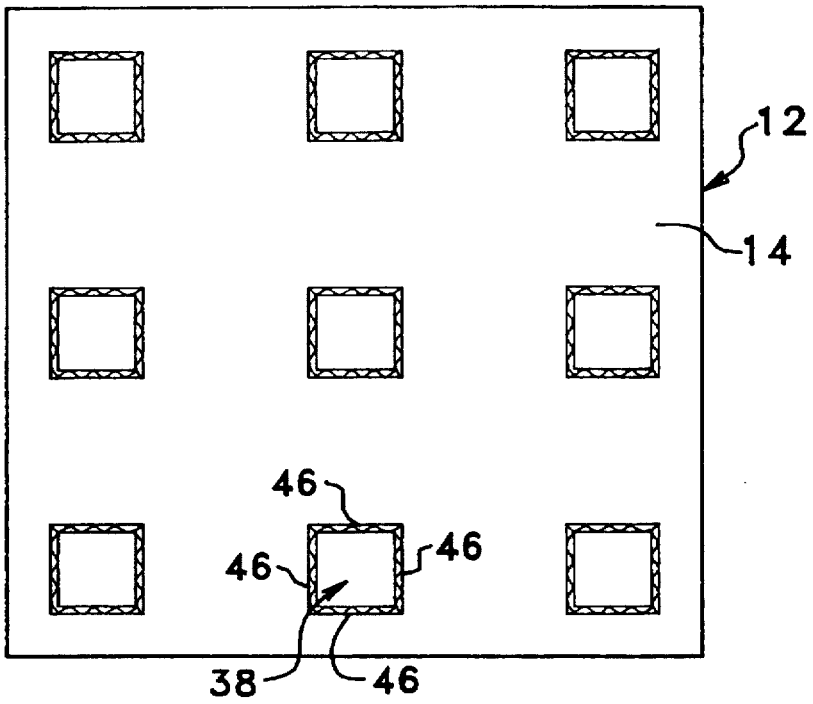
FIG. 8 is a plan top view of the single sheet corrugated pallet showing the fluted ends of the support members extending through the openings formed in the primary support sheet.
Figure 9:
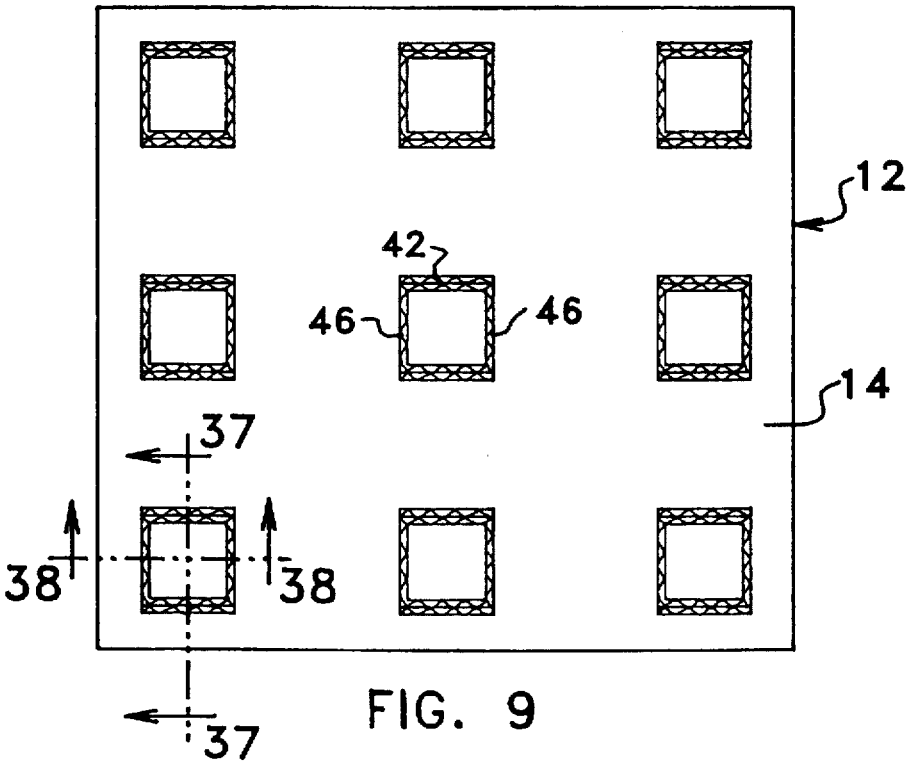
FIG. 9 is a plan bottom view of the single sheet corrugated pallet showing the fluted ends of the support members between the fluted panel ends.

FIG. 8 shows a plan top view of flutes 46 of the support members 38 extending through the primary support sheet 14. FIG. 9 is a plan bottom view of the single sheet corrugated pallet 12 showing the fluted ends 46 of the support members 38 between the flutes 44 of the foldable panels 18. Furthermore it is contemplated that several layers of multiple ply sheets may be adhesively connected forming layers of corrugated sheets in combination with the primarily panel 14 and support members 16 having multiple layers of fluting to provide the desired strength required for a particular load carrying application.

Figure 10:
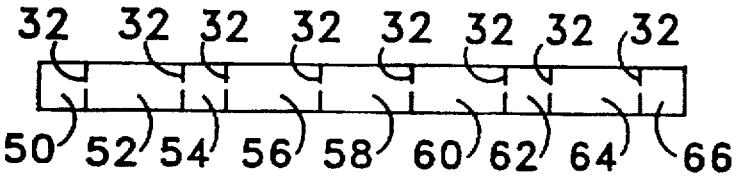
FIG. 10 is a front plan view showing a strip of corrugated material having a plurality of perforations therein forming score lines for foldably forming a support member having a reinforcement of a single sheet corrugated pallet.
Figure 11:
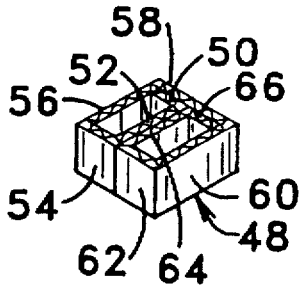
FIG. 11 is an exploded perspective view showing a reinforced support member of a single sheet corrugated pallet.
Figure 12:
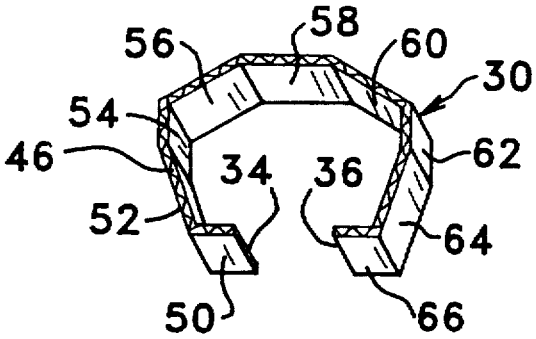
FIG. 12 is an elevational perspective view showing a reinforced support member of a single sheet corrugated pallet.
Figure 13:
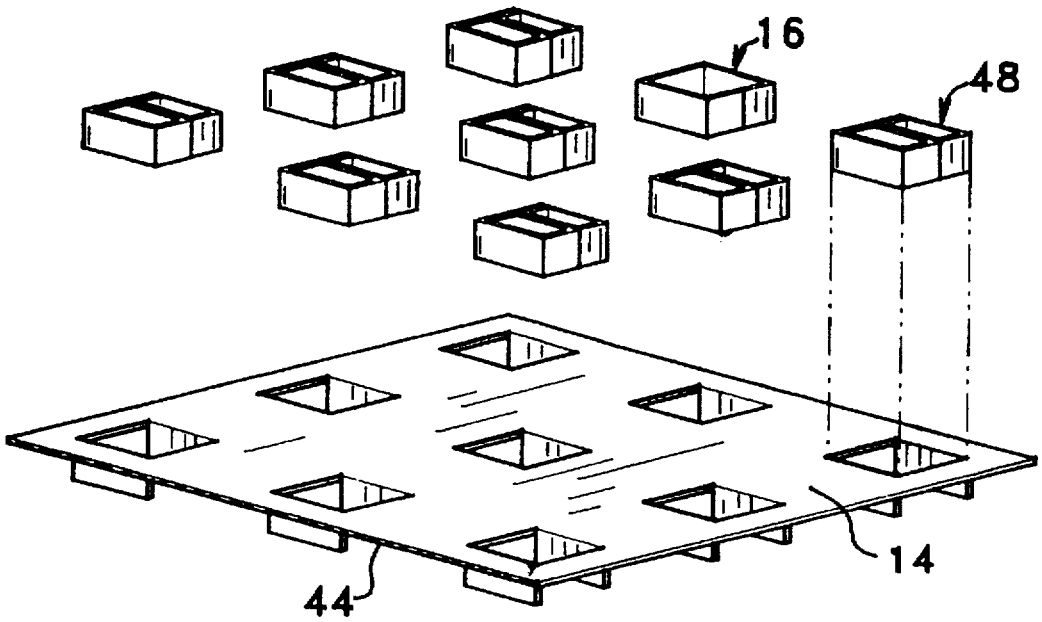
FIG. 13 is an exploded perspective view showing alignment of the reinforced support members with the panels formed within the primary support sheet of a single sheet corrugated pallet.

FIGS. 10–12 show an alternate embodiment of a reinforced support member 48 fabricated from a strip 30 of corrugated material having eight score lines 32 extending normal to the longitudinal axis of the strip 30 forming strip sections (50, 52, 54, 56, 58, 60, 62, 64, and 66). The distal ends 34 and 36 are folded inwardly so that the outer surface of strip sections 50 and 66 are contiguous with and adhesively secured to the inner surface of strip section 58 thereby forming a "T"-shaped double layer reinforcing means within the reinforced support member 48. The reinforced support members 48 may be inserted into the primary support panels 14, 48 instead of, or in addition to the square support members 16 such as is shown in FIG. 13.

Figure 14:
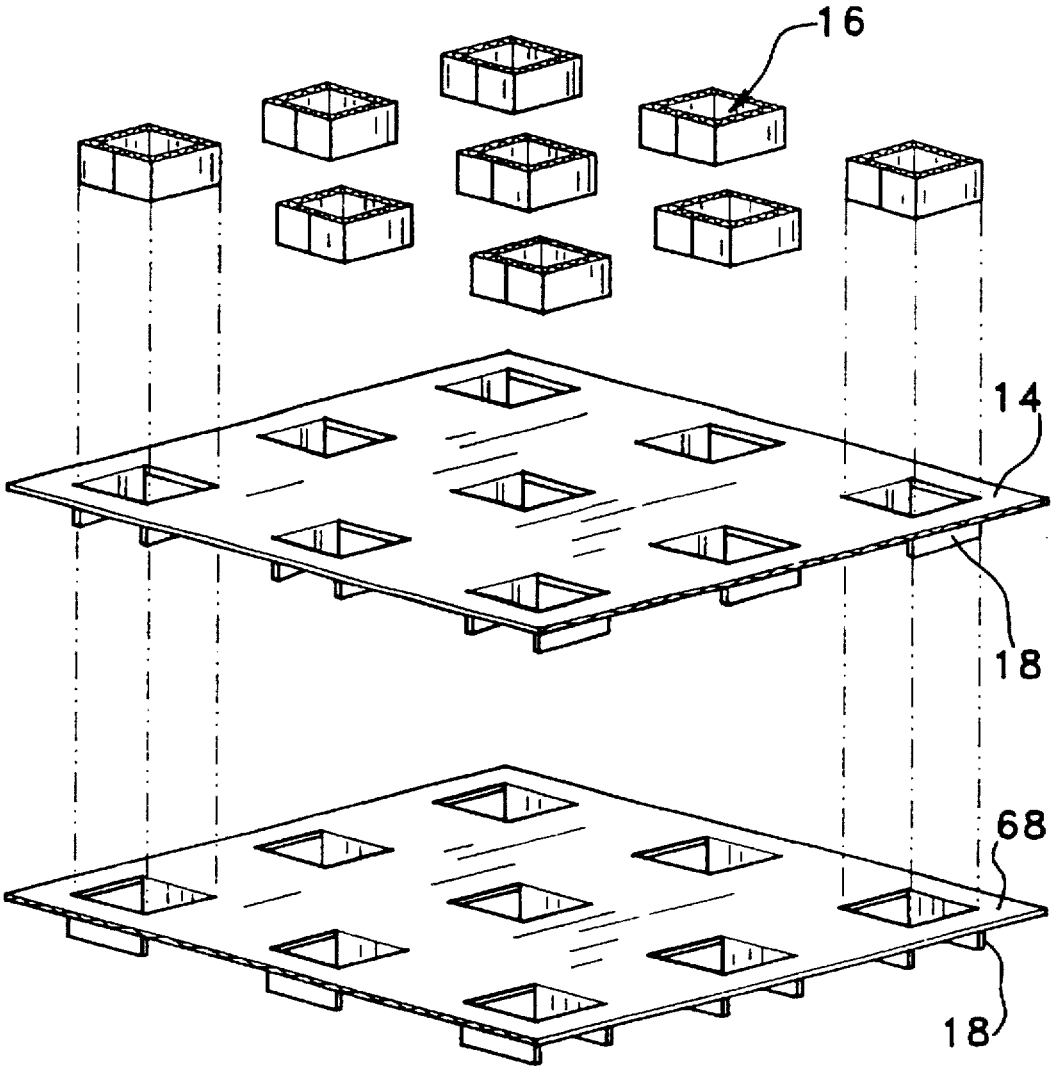
FIG. 14 is an elevational perspective view showing insertion of support members through the template cut and scored in a first primary support sheet and a second primary support sheet rotated on its axis 90 degrees with respect to the first primary support sheet, pushing the portion of the primary support sheets along the centercut downward and simultaneously bending the primary support sheets along the crease scored therein forming four panel legs.
Figure 15:
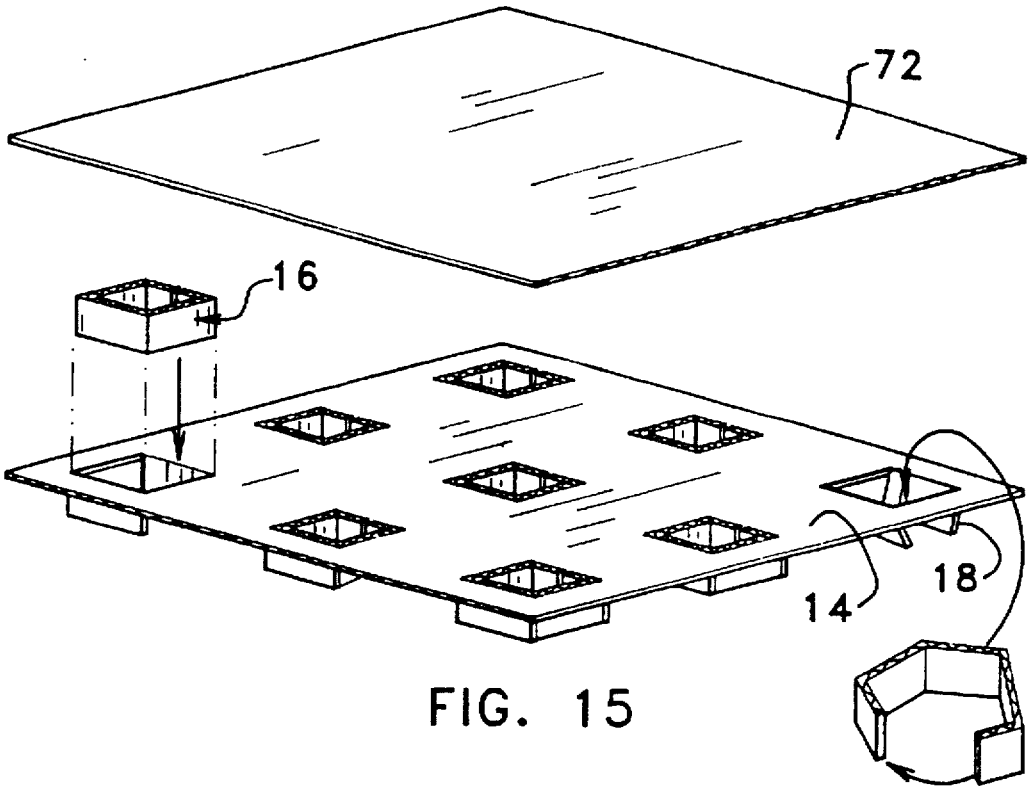
FIG. 15 is an exploded perspective view showing alignment of a support member between the panels formed in the primary support sheet and the alignment of a top cover sheet forming a double sheet laminated corrugated pallet.

A second primary support sheet 68 having identically panel templates formed by parallel cut lines 20, center cut lines 22 and score lines 32, may be rotated 90 degrees with respect to the first primary support sheet 14 so that the cut and score lines of one sheet are perpendicular to the same cut and score lines of the other sheet. An adhesive is applied to the top surface of the first primary support sheet 14 forming the bottom sheet. The second primary support sheet 68 is stacked upon the first primary support sheet 14 such that the squares of one are vertically juxtaposed upon the squares of the other sheet as shown in FIG. 14. Insertion of the support members 16, 48 through the sheets 14 and 68 depresses the foldable panels 18 downwardly and simultaneously spreads the adhesive from the surface of the first primary support panel 14 and/or second primary support panel 68 onto the outer surface of the support member 16 to securely hold the support member securely thereinbetween the four panel legs 26. This design forms a double sheet corrugated pallet 70 which maximizes the strength of the skid while minimizing the weight of the corrugated pallet 10.

Figure 16:
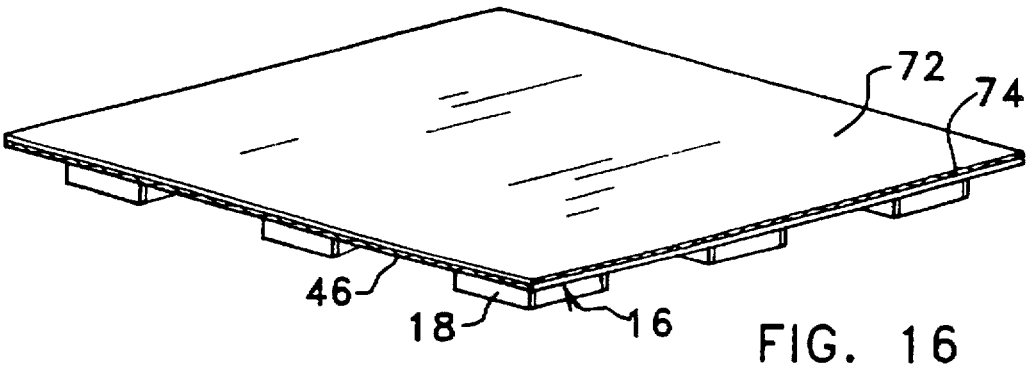
FIG. 16 is an elevated perspective view showing a double sheet laminated corrugated pallet of FIG. 16.
Figure 17:
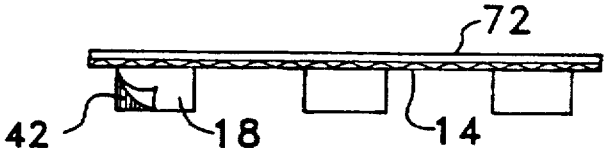
FIG. 17 is an elevational end view of the double sheet laminated corrugated pallet showing the orientation of the panel lutes of the top sheet in alignment perpendicular with respect to the lutes in the primary support sheet.
Figure 18:
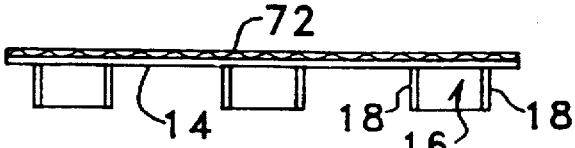
FIG. 18 is an elevational side view of the double sheet laminated corrugated pallet showing the edges of the panels attached to the support members.

As shown in FIGS. 15–18, an alternate embodiment of the present invention employs a first top double fluted multi-ply laminate support sheet 72 as a top cover sheet adhesively bonded to the surface of the primary support sheet 14, 68, and the fluted edges 46 of the corrugated support members 16, 48. The top support sheet 72 is usually rotated 90 degrees before adhesion to the primary support sheet 14 or 68 so that the laminate sheet flutes 74 run perpendicular to the primary support sheet flutes 44 to maximize the strength of the corrugated pallet 10 as shown in FIG. 16. The primary support sheet flutes 44 run parallel with the foldable panel flutes 42 as illustrated in FIGS. 17 and 18.

Figure 19:
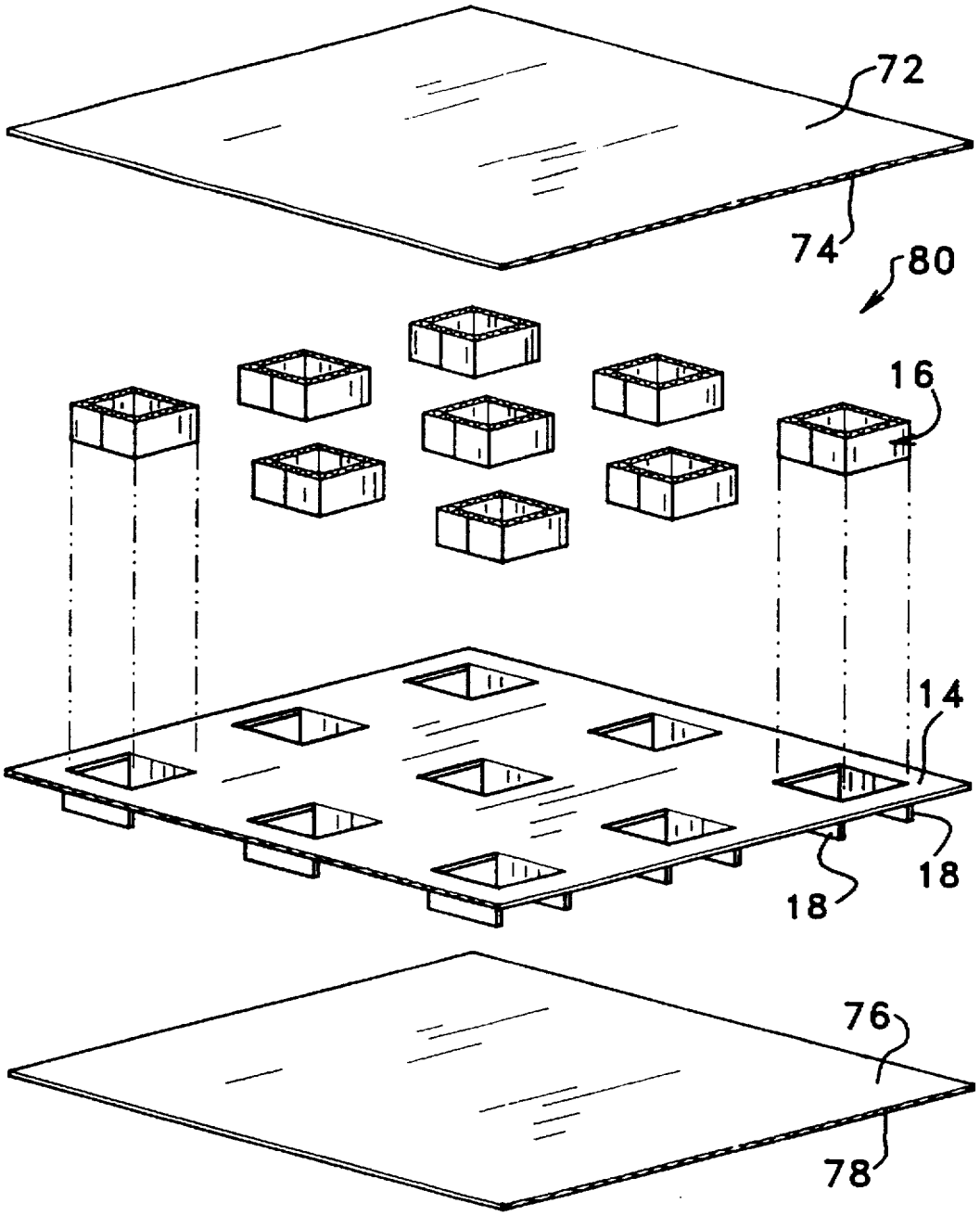
FIG. 19 is an explored perspective view showing alignment of a support member between the panels formed in the primary support sheet, and the alignment of a top cover sheet and bottom base sheet forming a triple sheet laminated corrugated pallet.
Figure 20:
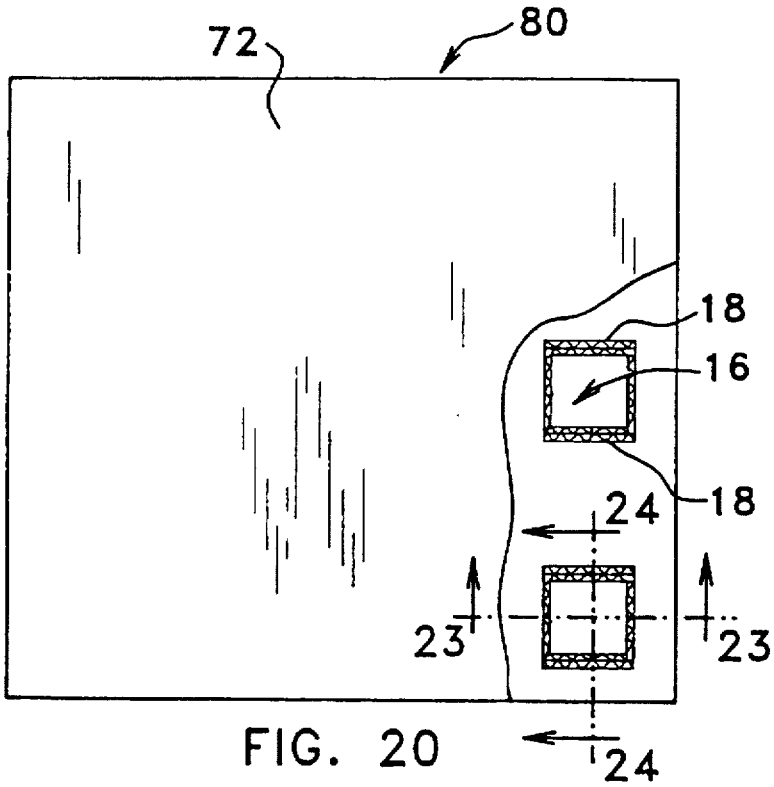
FIG. 20 is a top plan view of FIG. 19 depicting a cut-away section showing the flutes of the primary support sheet panels and support members therein.
Figure 21:
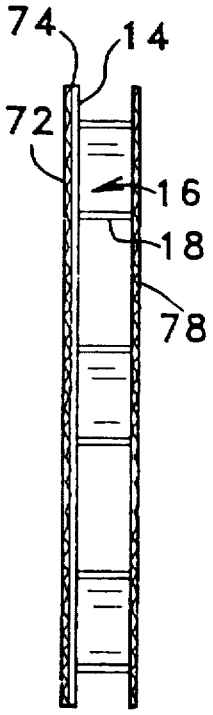
FIG. 21 is a right side view of FIG. 19 showing the flutes of the top cover sheet running parallel with the panels of the bottom base sheet and normal to the flutes of the primary support sheet.
Figure 22:
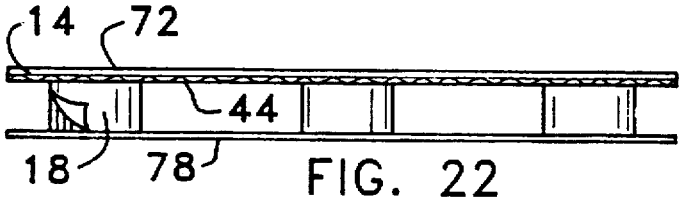
FIG. 22 is an end view of FIG. 19 showing the primary support sheet and panel flutes.

Moreover, as shown in FIG. 19, a fluted multi-ply base sheet 76 may also be adhesively secured to the edges of the panel legs 28 and edges of the support members 16 secured therein forming a triple sheet corrugated pallet 80. As with the top sheet, the base sheet 76 is usually rotated 90 degrees before adhesion to the primary support sheet 14, 68 so that the laminate sheet flutes 74 run perpendicular to the primary support sheet flutes 44 to maximize the strength of the triple sheet corrugated pallet 80. As illustrated in FIG. 21, the first laminate sheet flutes 74 run parallel with the base sheet flutes 78 opposite the primary support sheet flutes 44 and foldable panel flutes 42 as shown in FIGS. 22–24.

An alternate embodiment of the present invention is shown in FIGS. 25–30, comprising a base sheet 76 adhesively secured to the edges of the panel legs 28 and edges of the support members 16 adhesively secured around the panel legs 28 forming a triple sheet laminated corrugated pallet 80. The top laminate support sheet 72 and the base sheet 76 are generally rotated 90 degrees before adhesion to the primary support sheet 14, 68 so that the laminate sheet flutes 74 run perpendicular to the primary support sheet flutes 44 to maximize the strength of the triple sheet corrugated pallet 80. As illustrated in FIGS. 25–30, the first laminate sheet flutes 74 run parallel with the base sheet flutes 78 opposite the primary support sheet flutes 44 and foldable panel flutes 42.

Figure 25:
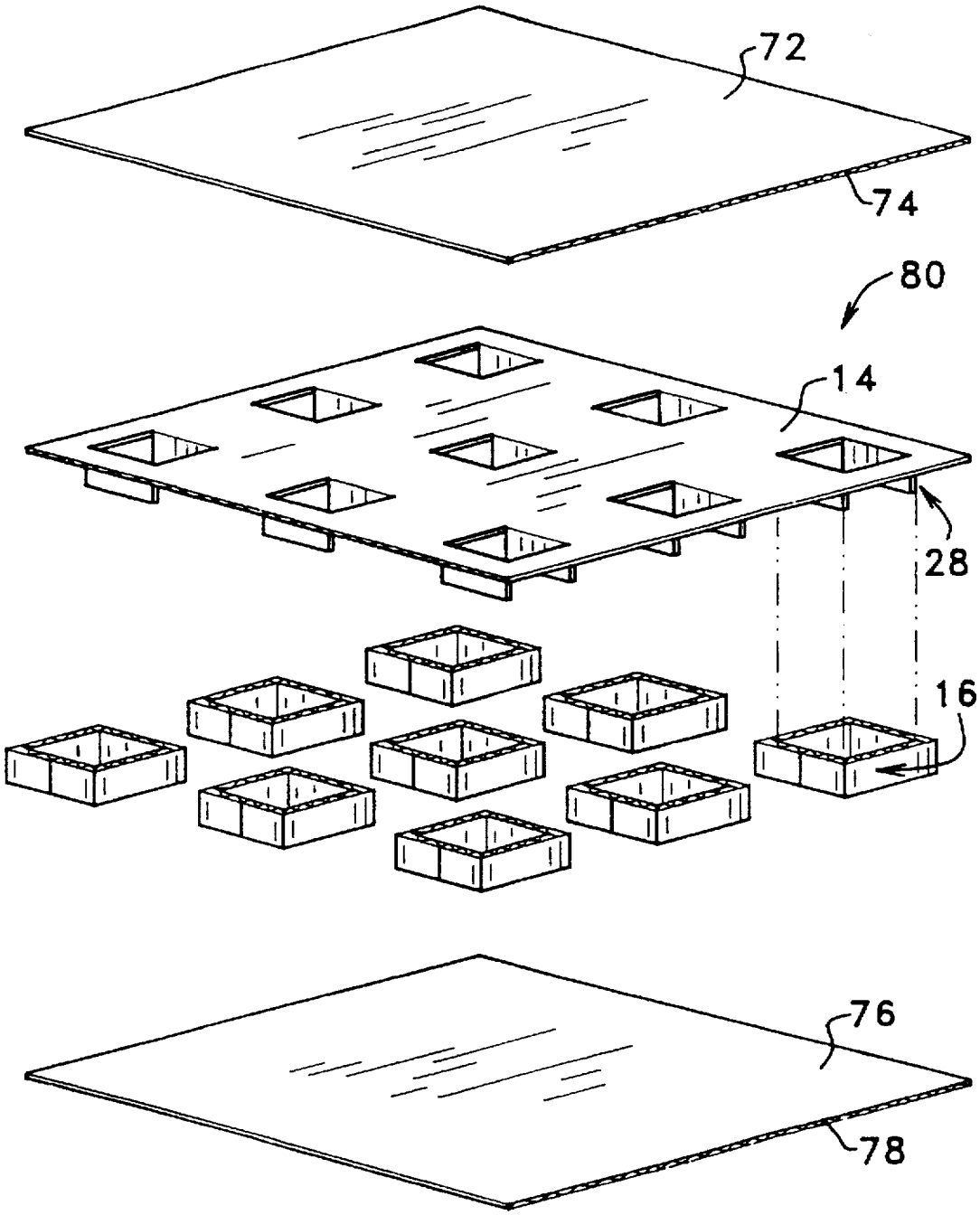
FIG. 25 is an explored perspective view showing alignment of support members around the panels formed in the primary support sheet, and the alignment of a top cover sheet and bottom base sheet forming a triple sheet laminated corrugated pallet.
Figure 26:
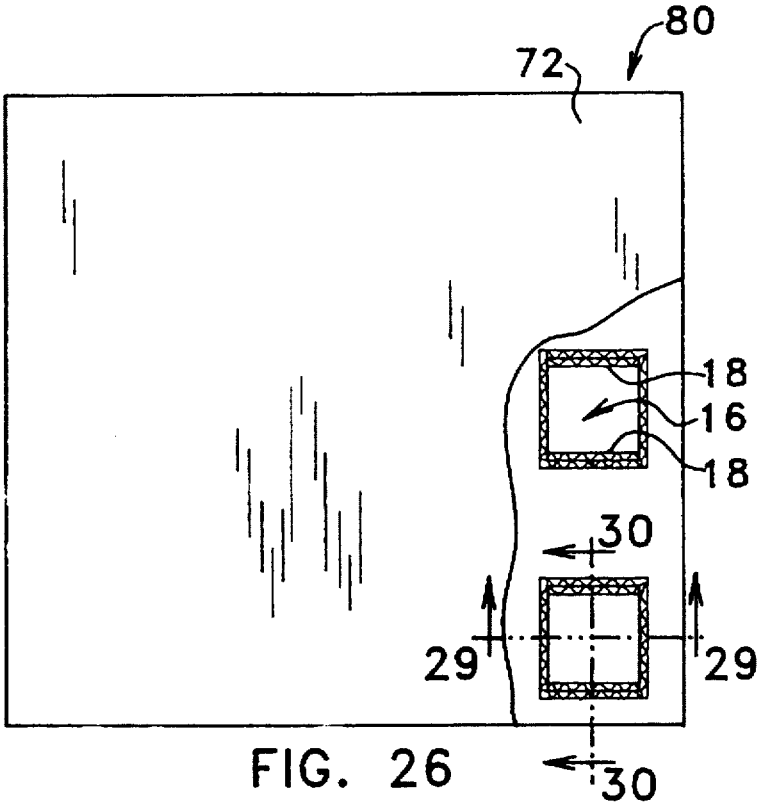
FIG. 26 is a top plan view depicting a cut-away section showing the flutes of the primary support sheet panels surrounded by the support members.
Figure 27:
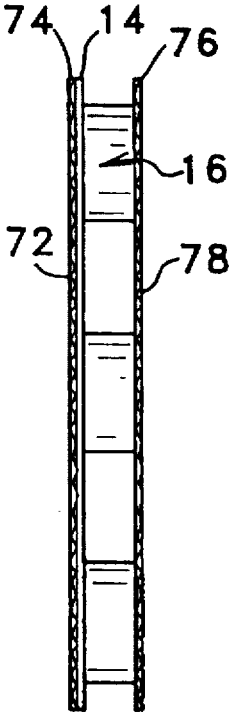
FIG. 27 is a side view of FIG. 26 showing the flutes of the top cover sheet running parallel with the panels of the bottom base sheet and normal to the flutes of the primary support sheet.
Figure 28:
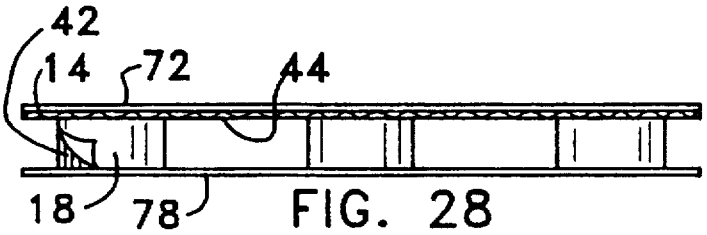
FIG. 28 is an end view of FIG. 26 showing the primary support sheet and panel flutes.
Figure 31:
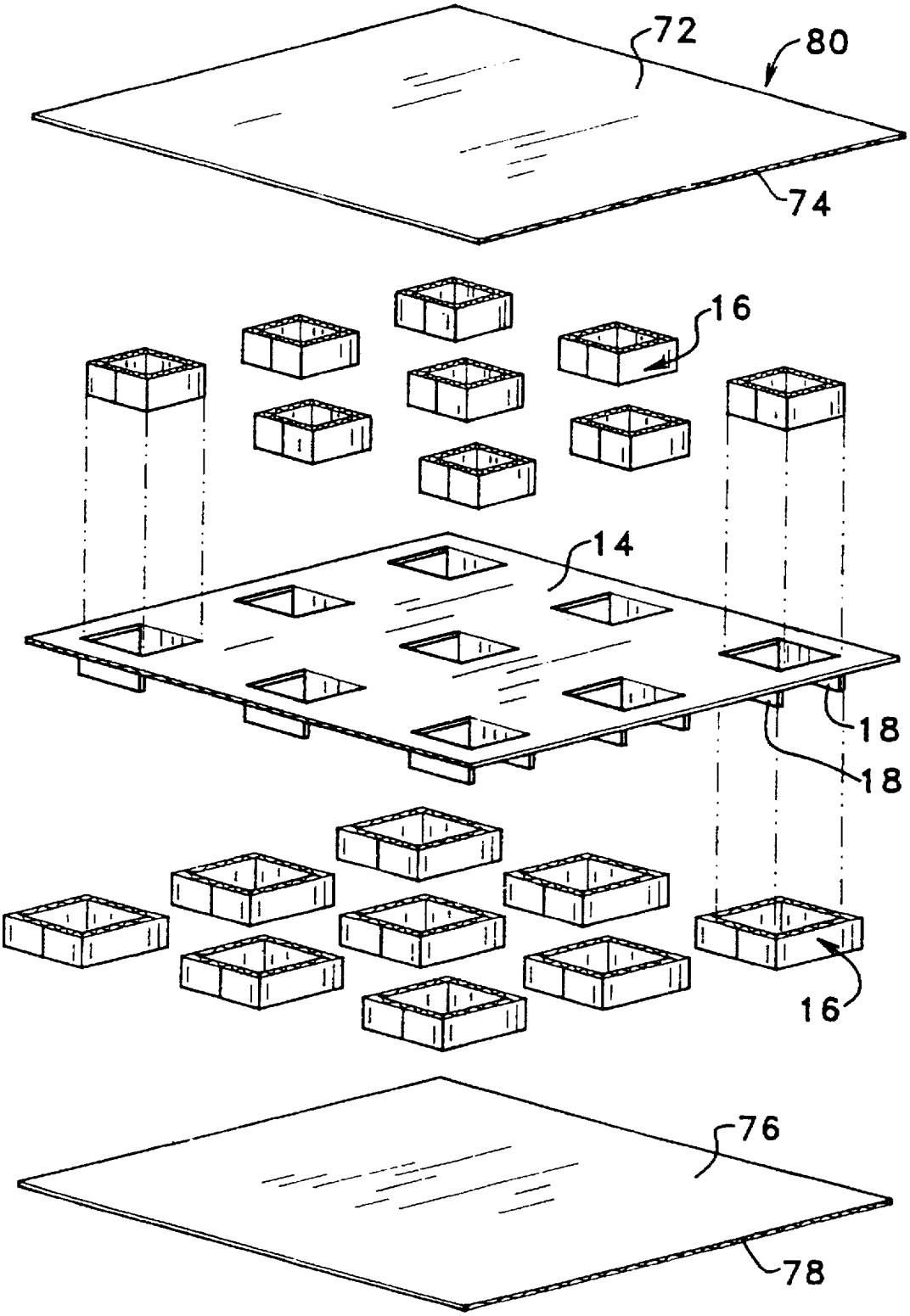
FIG. 31 is an explored perspective view showing alignment of support members within the primary support sheet panels and support members around the primary support sheet panels, and the alignment of a top cover sheet and bottom base sheet forming a triple sheet laminated corrugated pallet.

Another embodiment of the present invention combines the features of the triple sheet corrugated pallet 80 shown in FIGS. 19 and 25, by utilizing support members 16 inserted within and adhesively secured between the inner surfaces of the foldable panels 18, in conjunction with support members 16 surrounding and adhesively secured to the outer surface of the foldable panels 18 as best illustrated in FIG. 31.

Figure 32:
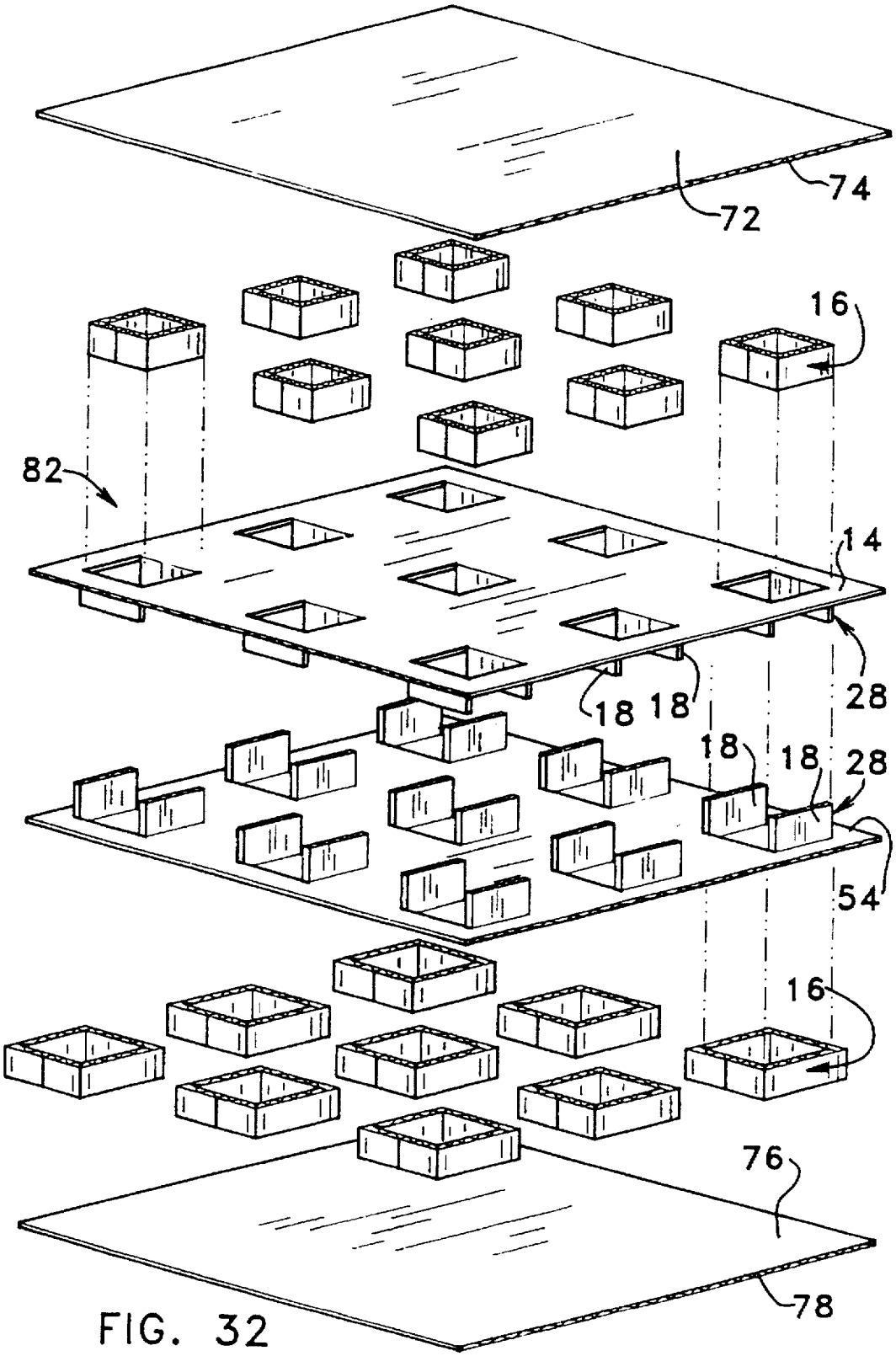
FIG. 32 is an elevational perspective view showing insertion of support members through the template cut and scored in a first primary support sheet and an inverted second primary support sheet rotated on its axis 90 degrees with respect to the first primary support sheet forming four panel legs thereinbetween, wherein the first and second primary support sheets are sandwiched between a top cover sheet and bottom base sheet.

Furthermore, an alternate version of the present invention is shown in FIG. 32 comprising a quadruple sheet corrugated pallet 82 which utilizes the same aforementioned first primary support panel 14 and second primary support sheet 68 as shown in FIG. 14; however, the second primary support sheet 68 is inverted and rotated 90 degrees with respect to the first primary support sheet 14 so that the cut and score lines of one sheet are perpendicular to the same cut and score lines of the other sheet. The second primary support sheet 68 is stacked upon the first primary support sheet 14 such that the squares of one are vertically juxtaposed upon the squares of the other sheet so that the foldable panels 18 of the first primary support sheet 14 extend through the openings formed in the second primary support sheet 46 and vice versa. Insertion of inner support members 16 through the sheets 14 and 68 from above or below expands the foldable panels 18 and simultaneously spreads the adhesive from the surface of the first primary support sheet 14 and/or second primary support sheet 46 onto the outer surface of the support member 16 to securely hold the support member 16 securely thereinbetween the four panels 18 forming the panel legs 26. The outer support members 16 is positioned around and adhesively attached to the panel legs 26 in conjunction with the inner support members 16 to provide additional structural support. Moreover, the first laminate sheet 54 forms a cover sheet which is adhesively secured to the edges of the inner and outer support members 16 and the surface of the primary support sheet 14. A base sheet 76 is adhesively secured to the bottom edges of the support members 16 and the surface of the second primary support sheet 68. It is contemplated that several laminate sheets 54 may be stacked together in combination with the primary support sheets 14, 68 and support members 16, to provide a simple, inexpensive, and efficient method of increasing the strength to weight ratio of the corrugated pallet 82.

Figure 33:
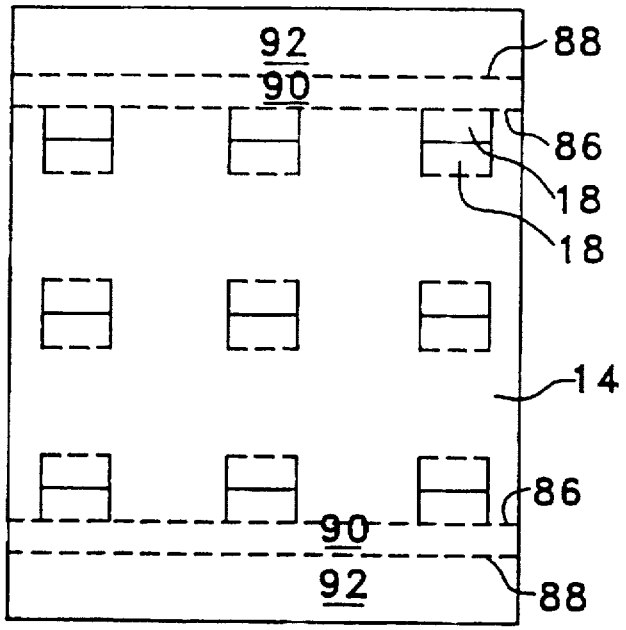
FIG. 33 is a top plan view of showing a primary support sheet having a plurality of perforations and scores therein forming side runners therefrom.
Figure 34:
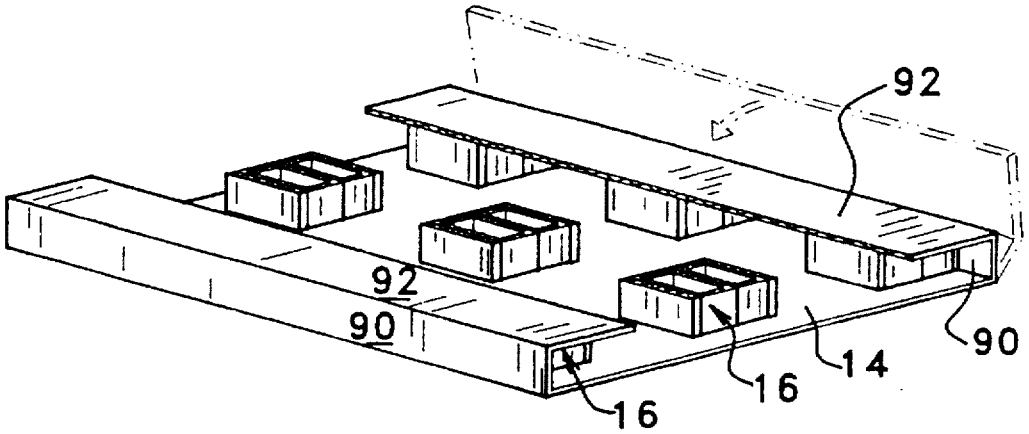
FIG. 34 is a bottom perspective view of FIG. 33 showing a single sheet corrugated pallet having a pair of outer panels folded downwardly and inwardly around the outer support members forming side runners.

As set forth in FIGS. 33 and 34, additional supporting structures such as side rails or side runners 84 may be fabricated in combination with the folding panels 18 from a single primary support sheet 14 or base sheet 76. The side runners 84 add substantial lateral stability and extra strength around the edge of the corrugated pallet 10 which is subjected to the greatest load strain and stress. Furthermore, the side runners 84 perform as guide means for guiding the lift truck forks and providing a means for orienting the skids during stacking. As shown in the drawings, the sheet 14 is perforated with a pair of spaced apart parallel score lines consisting of inner score line 86 and outer score line 88 forming an inner panel 90 and outer panel 92 on each side of the primary support sheet 14. The score line for the inner panel 90 is positioned near the score line of the outer support members 16 or support legs 26. As shown in FIG. 34, support members 16 or reinforced support members 48 are inserted and adhesively secured in-between or around the panel legs 26 of a primary support sheet 14 or adhesively affixed to the bottom of a base sheet 76. The inner panels 90 and outer panels 92 are folded inwardly around the outer side panel legs 26 and support members 16 therein or therearound forming side rails 84 on each side of the corrugated pallet 10. It is contemplated that a base sheet 76 and/or top support sheet 72 may be used in combination with the primary support sheet 14 having side runners 84.

Figure 35:
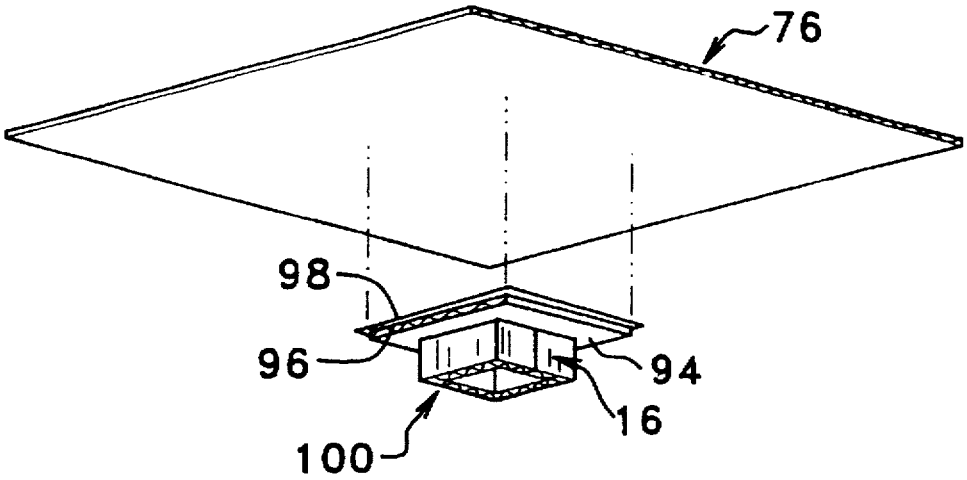
FIG. 35 is a perspective view of a support base member.
Figure 36:
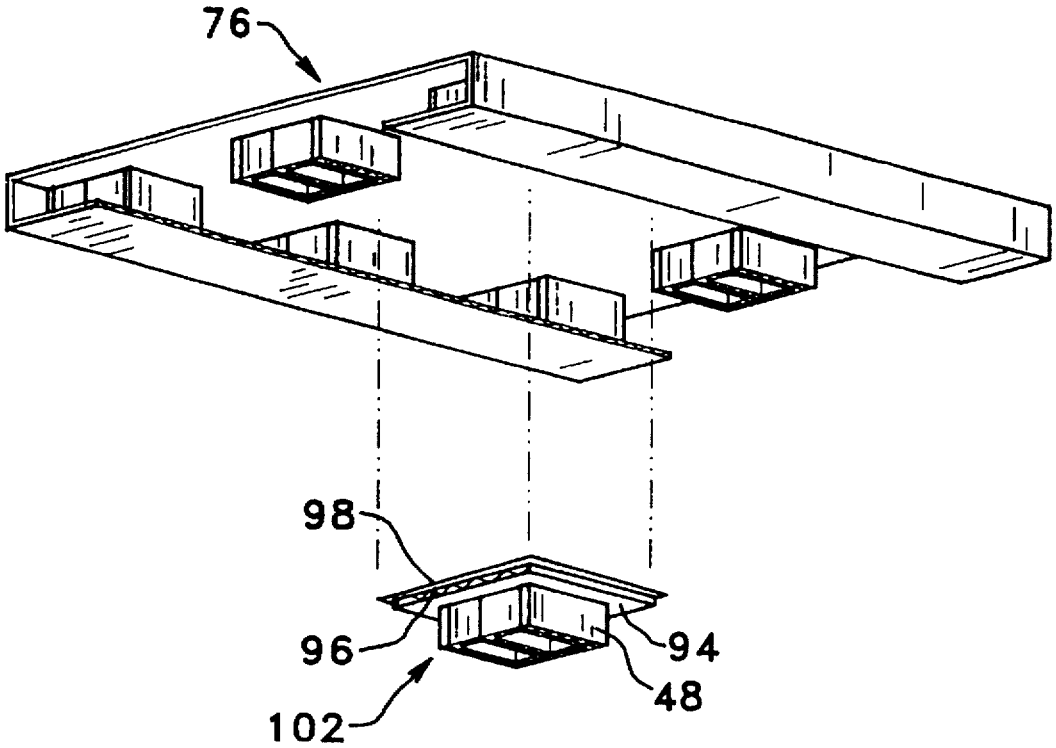
FIG. 36 is a perspective view of a reinforced support base member.
Figure 37:
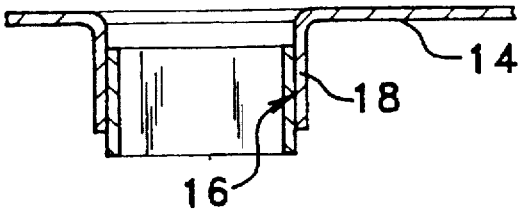
FIG. 37 is a sectional view taken along lines 37—37 of FIG. 9 showing the sides of the support member extending below the surface of the primary support panel disposed between a pair of foldable panels.
Figure 38:
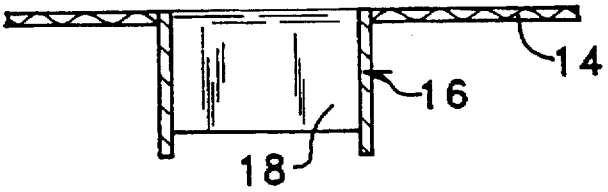
FIG. 38 is a sectional view taken along lines 38—38 of FIG. 9 showing the sides of the support member extending below the surface of one of the primary support panels.
Figure 39:
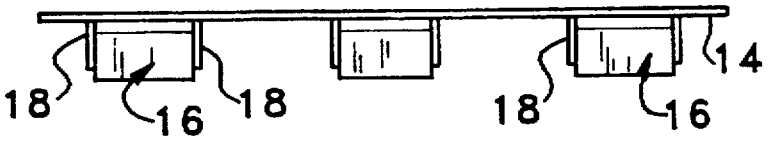
FIG. 39 is an elevated side view showing the sides of the support member extending below the surface of the primary support panel disposed between a pair of foldable panels.
Figure 40:
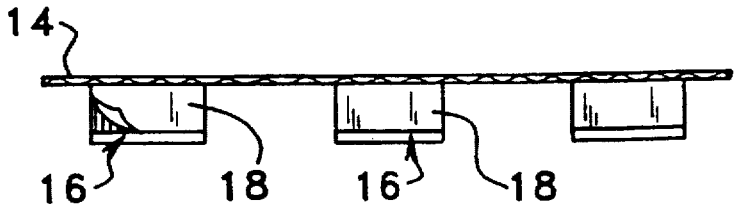
FIG. 40 is an elevated end view showing the support member extending below the surface of one of the primary support panels.

The support members 16 and reinforced support members 48 may also be adhesively secured to a pre-cut panel of flat corrugated material 94 having an adhesive backing 96 covered with a nonstick film, or waxed paper material 98 forming an independent support base member 100 or reinforced support base member 102 as shown in FIGS. 35 and 36. The base member 100 can be attached to the bottom of a primary support sheet 14 for additional structural support or a plurality of base members 100 may be attached to the bottom of a base sheet 76 for support, for stacking, or for providing a means to hold the corrugated pallet 10 up off of the floor.

FIGS. 41–68 illustrate several embodiments of multi-layered leg-wrap corrugated pallets 104 having longitudinal leg-wrap support members 106 extending the entire length of the corrugated pallet 104. The leg-wrap corrugated pallets 104 provide utilize longitudinal support means extending across the width of the pallet 10 and are adapted for portably moving extending the tines of a fork lift between the leg-wraps 106 and/or through passageways formed through the leg-wraps 106.

Figure 44:
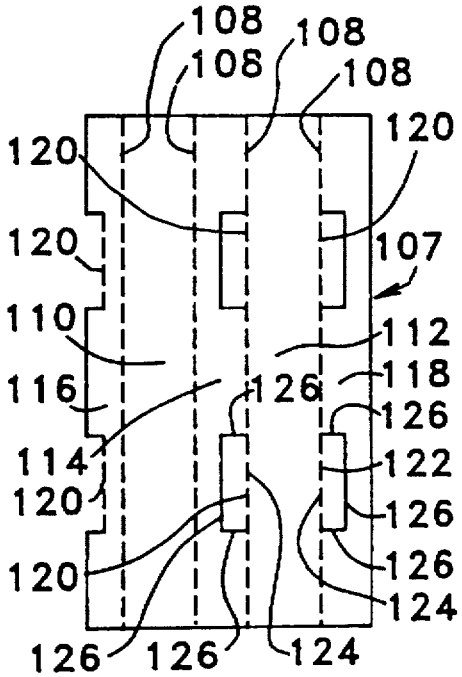
FIG. 44 is a top plan view of the corrugated panel of FIG. 43, showing a leg-wrap having the score lines shown in phantom lines.
Figure 49:
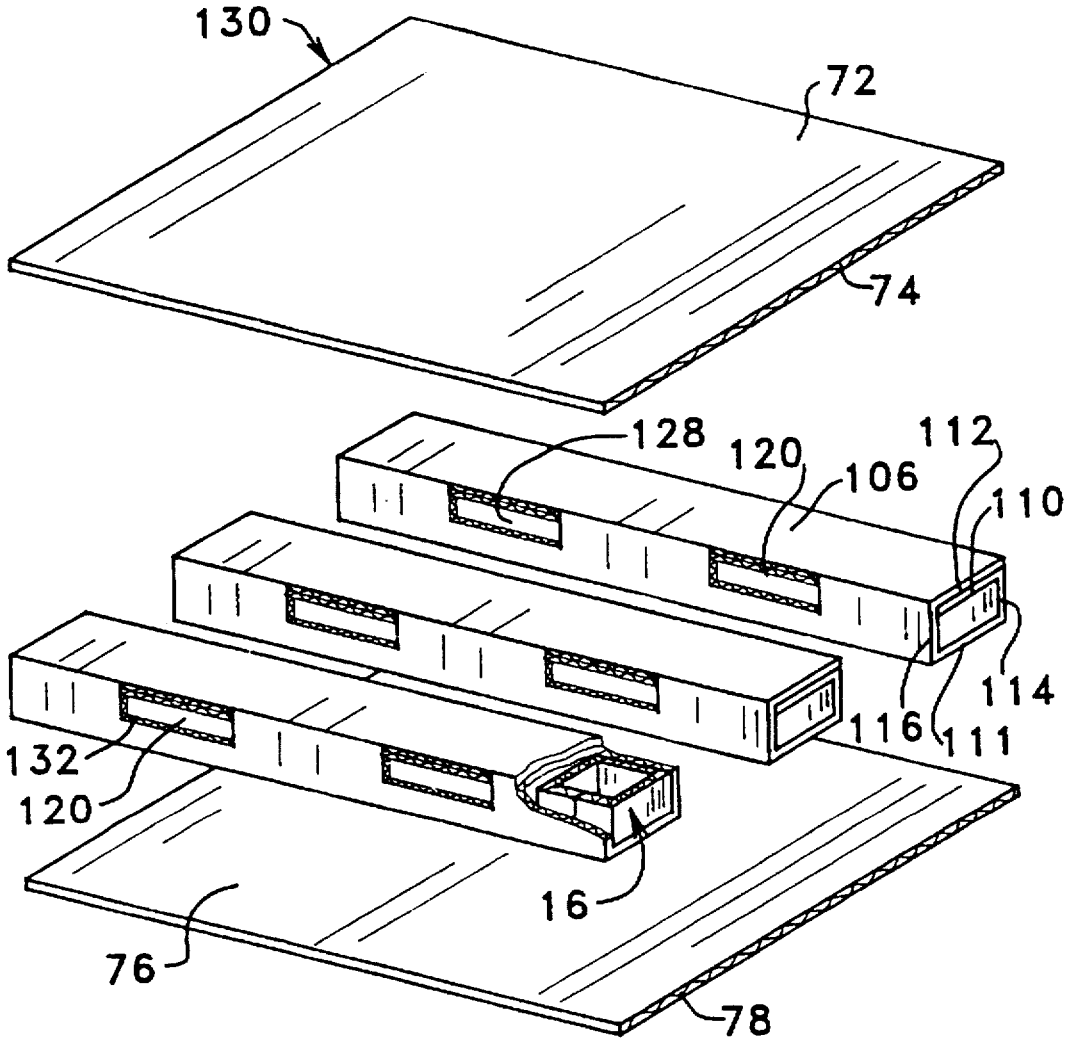
FIG. 49 is an exploded perspective view showing another preferred embodiment of a corrugated leg-wrap pallet in accordance with the present invention having a single multi-ply corrugated support sheet and single layer base sheet, and showing a cut-away view of one of the leg-wraps showing a support member disposed therein.
Figure 51:
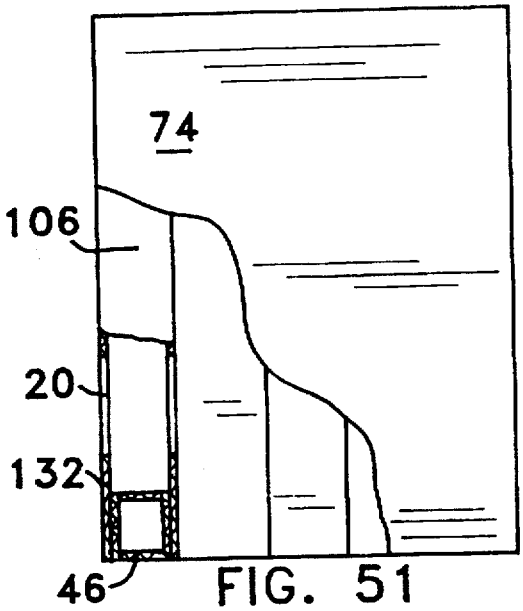
FIG. 51 is a top plan cut-away view of the corrugated pallet of FIG. 49, showing the leg-wrap and support member disposed therein.
Figure 52:
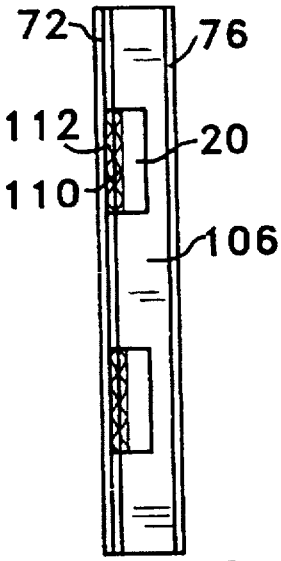
FIG. 52 is an end view of the corrugated pallet of FIG. 49, showing the slots formed within the leg-wraps.
Figure 53:
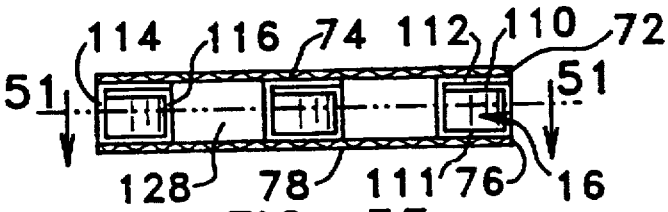
FIG. 53 is a sectional side view of FIG. 51, showing the position of the leg-wraps and support members disposed therein.
Figure 54:
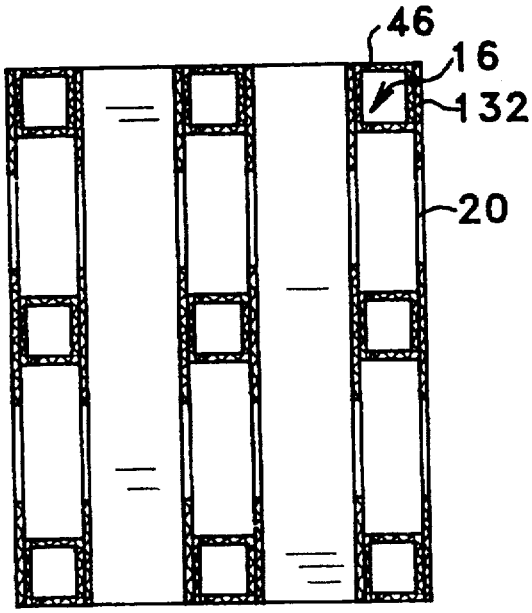
FIG. 54 is a cutaway plan top view of the corrugated pallet of FIG. 49, showing the position of the leg-wraps and the support members therein disposed between the passageways formed by the slots.
Figure 50:
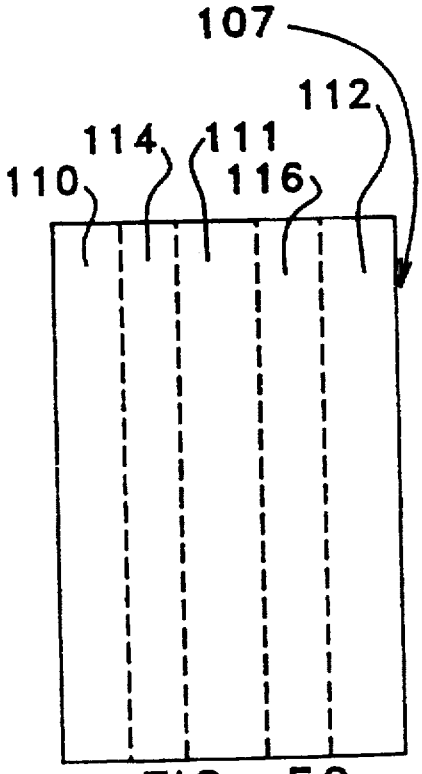
FIG. 50 is a top plan view of the corrugated panel of FIG. 49, showing a leg-wrap having the score lines shown in phantom lines.
Figure 55:
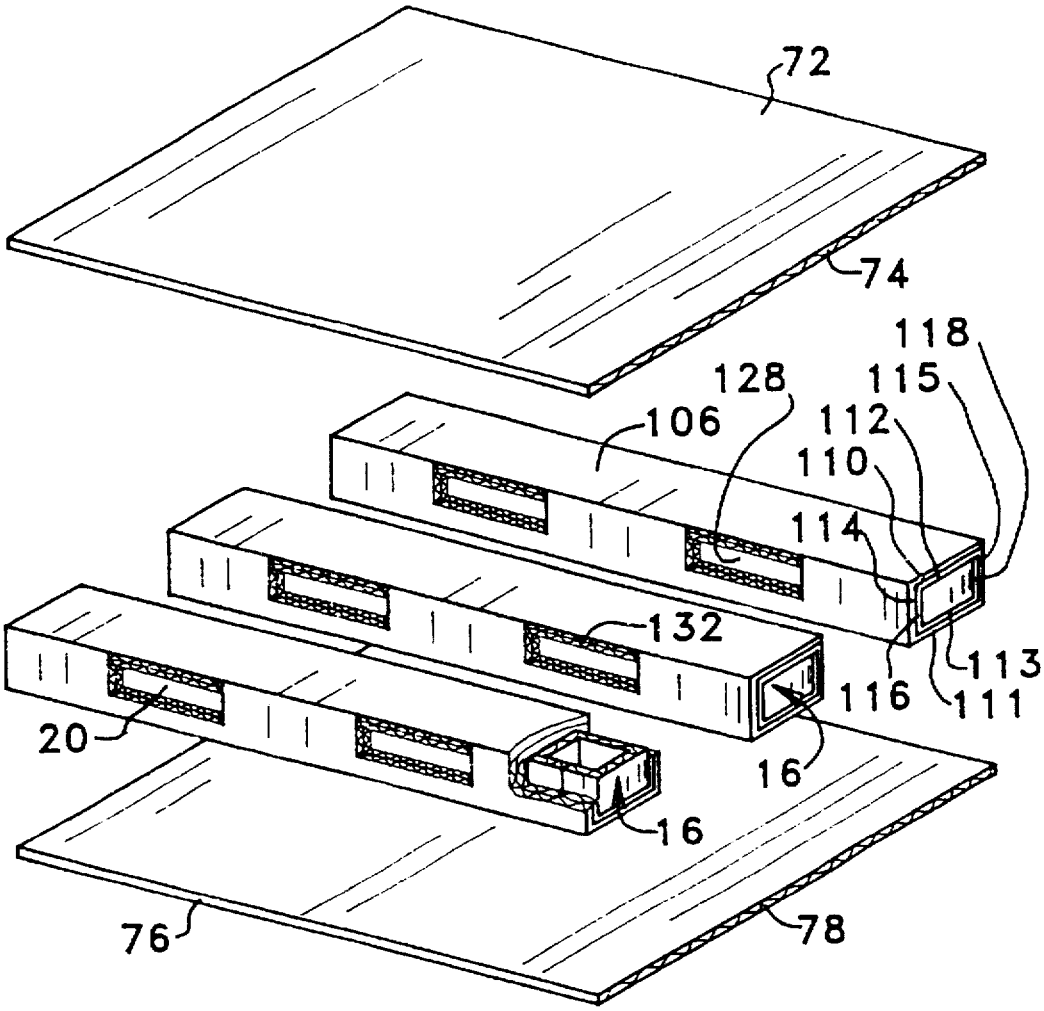
FIG. 55 is an exploded perspective view showing another preferred embodiment of a corrugated leg-wrap pallet in accordance with the present invention having a single multi-ply corrugated support sheet and single layer base sheet, and showing a cut-away view of one of the leg-wraps showing a support member disposed therein.
Figure 57:
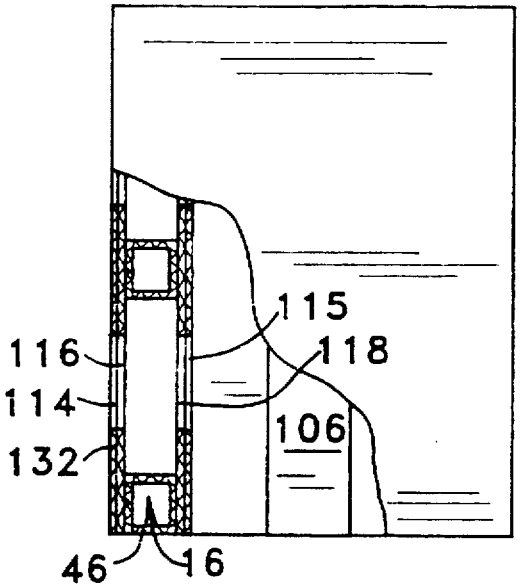
FIG. 57 is a top plan cut-away view of the corrugated pallet of FIG. 55, showing the leg-wrap and support member disposed therein.
Figure 58:
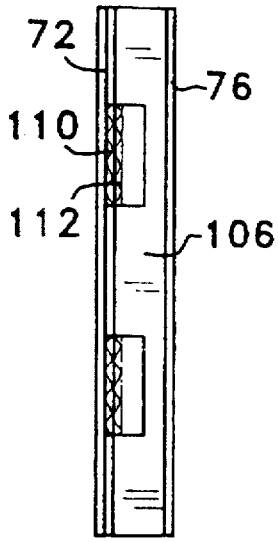
FIG. 58 is an end view of the corrugated pallet of FIG. 55, showing the slots formed within the leg-wraps.
Figure 59:
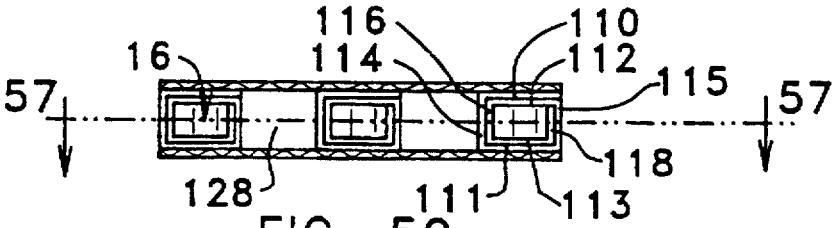
FIG. 59 is a sectional side view of FIG. 57, showing the position of the leg-wraps and support members disposed therein.
Figure 60:
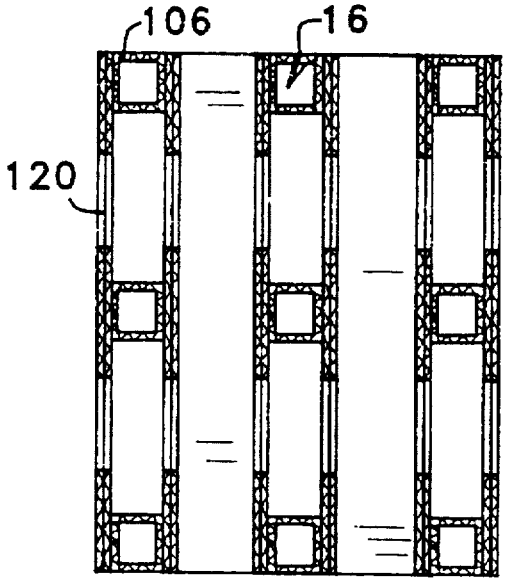
FIG. 60 is a cutaway plan top view of the corrugated pallet of FIG. 55, showing the position of the leg-wraps and the support members therein disposed between the passageways formed by the slots.
Figure 56:
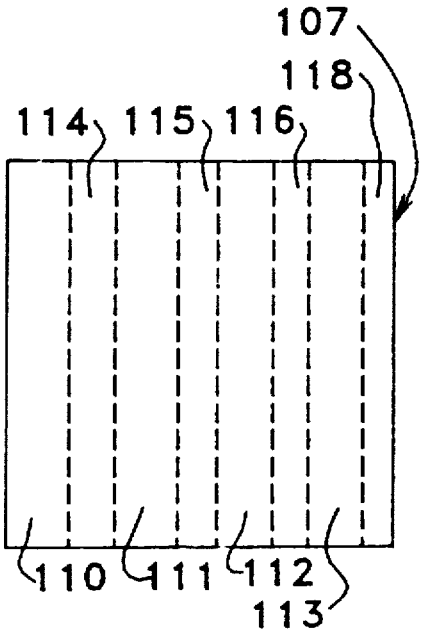
FIG. 56 is a top plan view of the corrugated panel of FIG. 55, showing a leg-wrap having the score lines shown in phantom lines.

As shown in FIG. 44, the leg wrap support members 106 are fabricated by scoring a multi-ply corrugated leg-wrap sheet 107 on one side and bending the sheet 107 around the plurality of spaced apart and parallel scores forming creases 108 therealong and panel sections thereinbetween. The creases 108 separate the corrugated sheet 107 into wide top and bottom panel sections having alternating narrow side sections thereinbetween. More particularly, a first wide panel section 110 and second wide panel section 112 are hingeably connected together by a first narrow side panel section 114 positioned thereinbetween. A second narrow side panel section 116 is hingeably connected to the first wide panel section 110, and a third narrow side panel section 118 is hingeably connected to the second wide panel section 112. A holding means, such as a pressure sensitive adhesive or water soluble glue, is applied between the outer narrow side panel sections 116 and 118 and the panel sections joining them together and forming the rectangular shaped leg-wrap supports 106.

Furthermore, transverse slots 120 or transverse slots with break-away flaps 122 may be formed in the leg-wrap supports 108 simultaneously with the scoring process. The flaps 120 and slots with flaps 122 are adapted to accommodate the tines of a fork lift truck.

Figure 41:
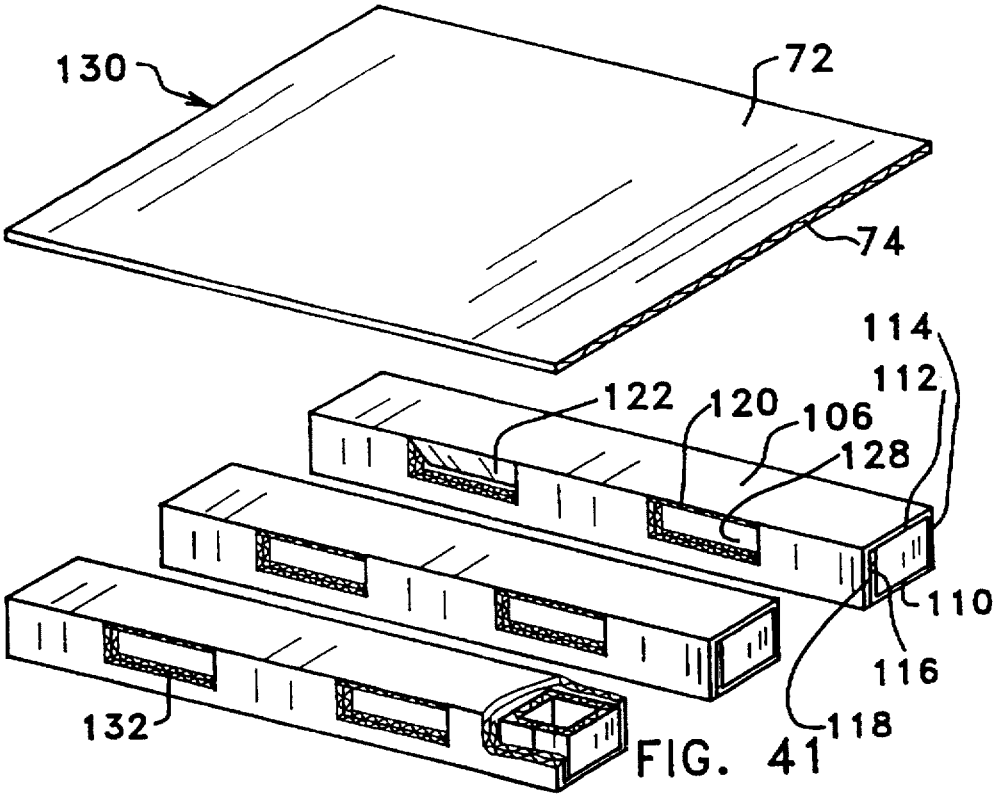
FIG. 41 is an exploded perspective view showing a corrugated leg-wrap pallet in accordance with the present invention having a single multi-ply corrugated support sheet and showing a cut-away view of one of the leg-wraps showing a support member disposed therein.
Figure 42:
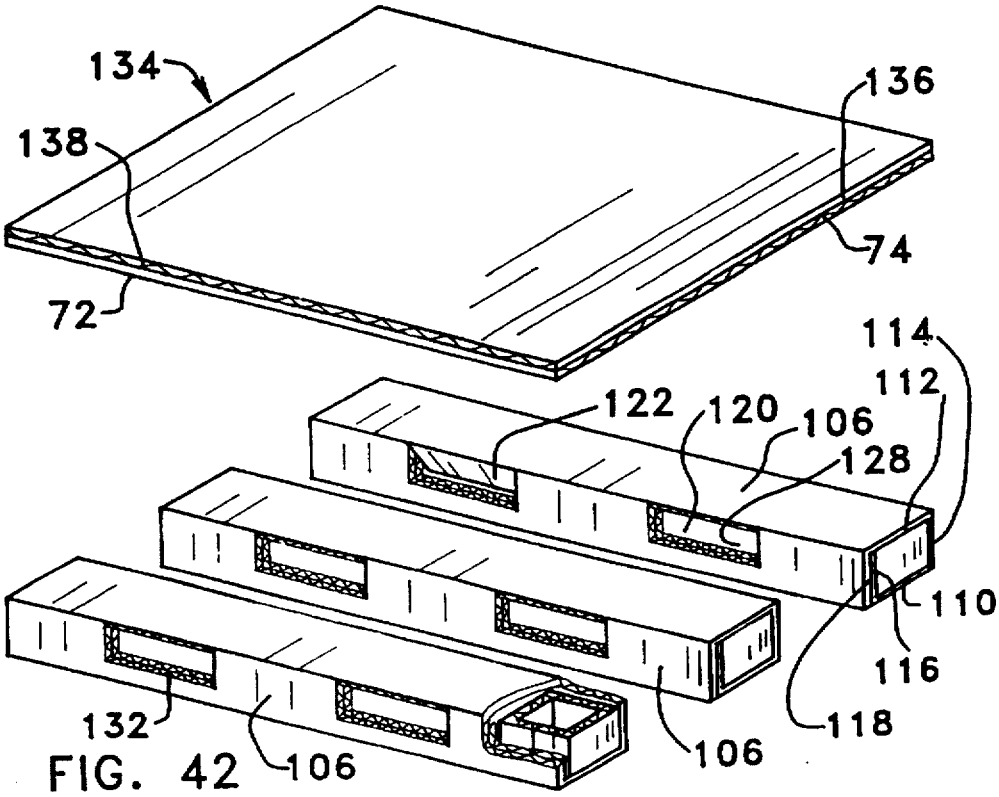
FIG. 42 is an exploded perspective view showing a corrugated leg-wrap pallet in accordance with the present invention having a multiple layers of multi-ply corrugated support sheets and showing a cut-away view of one of the leg-wraps showing a support member disposed therein.
Figure 43:
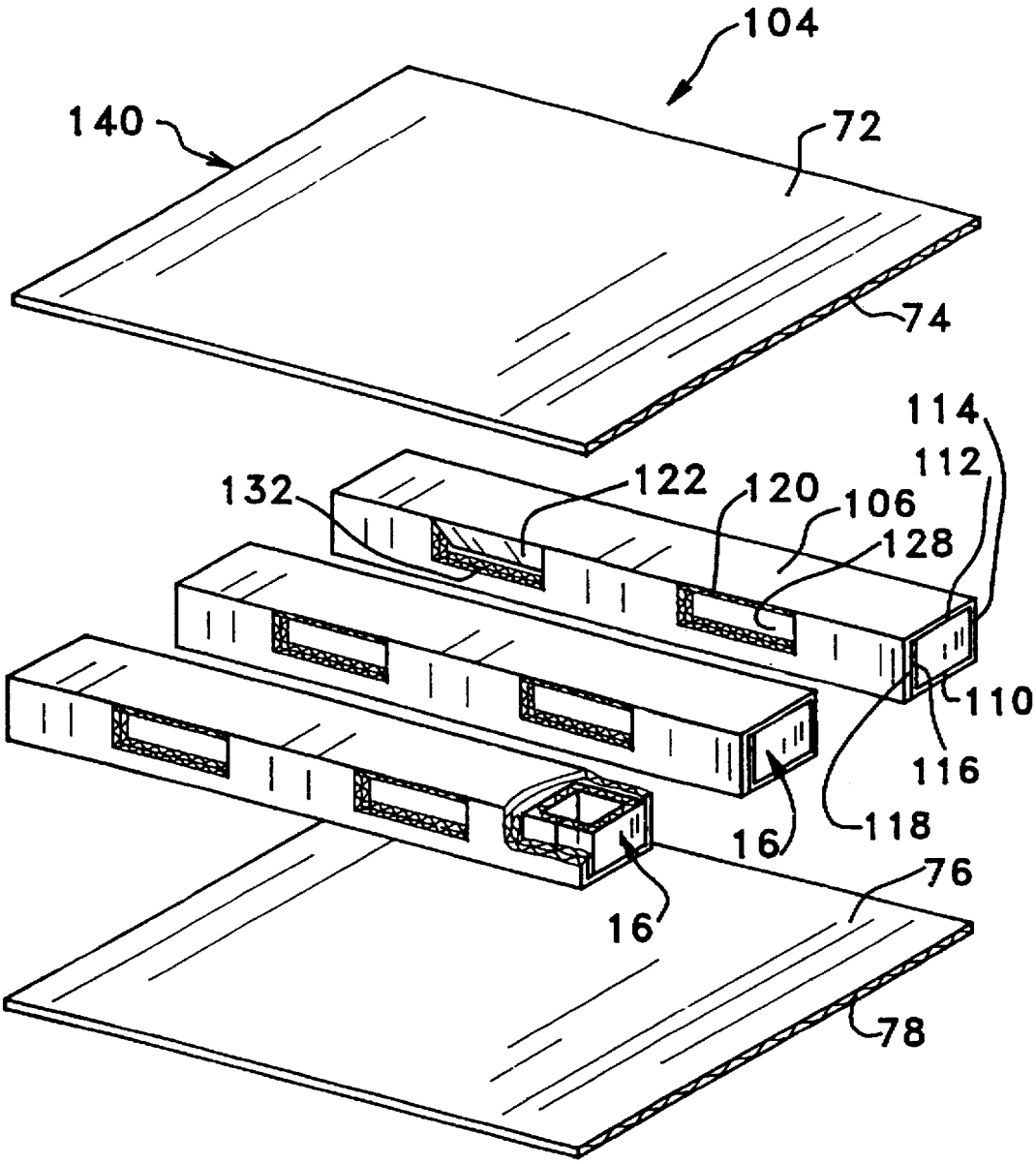
FIG. 43 is an exploded perspective view showing a corrugated leg-wrap pallet in accordance with the present invention having a single multi-ply corrugated support sheet and single layer base sheet, and showing a cut-away view of one of the leg-wraps showing a support member disposed therein.
Figure 45:
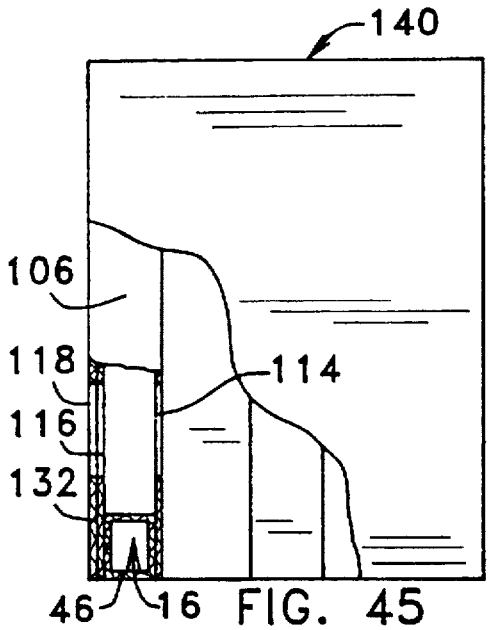
FIG. 45 is a top plan cut-away view of the corrugated pallet of FIG. 43, showing the leg-wrap and support member disposed therein.
Figure 46:
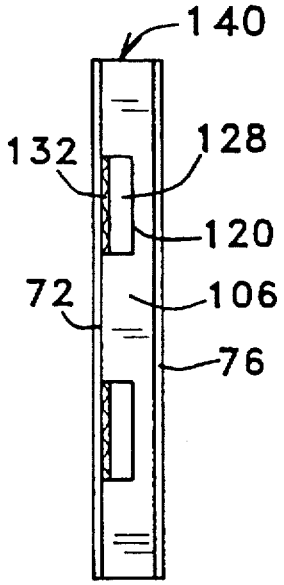
FIG. 46 is an end view of the corrugated pallet of FIG. 43, showing the slots formed within the leg-wraps.
Figure 47:
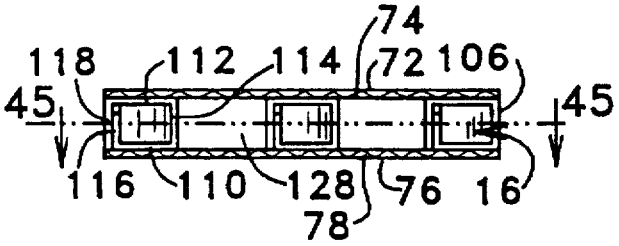
FIG. 47 is a sectional side view of FIG. 45, showing the position of the leg-wraps and support members disposed therein.
Figure 48:
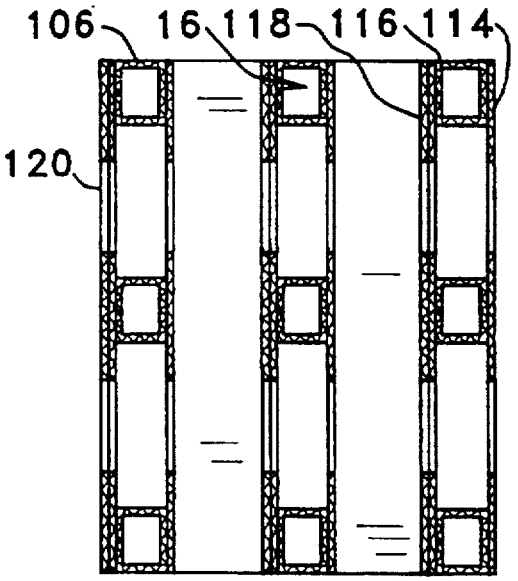
FIG. 48 is a cutaway plan top view of the corrugated pallet of FIG. 43, showing the position of the leg-wraps and the support members therein disposed between the passageways formed by the slots.

The slots with flaps 122 are formed by creating score lines 124 into and cuts 126 through the corrugated sheet 107 as best shown in FIGS. 41–44. The slots 120 are formed by stamping cuts 126 through the corrugated sheet 107. The panel sections 110–118 are folded along the creases 108 into position aligning the slots 120, 122 formed therein providing a generally rectangular shaped passageway or conduit 128 extending normal to the longitudinal axis of the leg-wrap 108 through the vertical side panel sections 114–118. The slots 120, 122 are sized to provide the necessary clearance according to the width and thickness of a typical fork lift tine. The slots 120, 122 are formed in the top portion of the narrow side panel sections 114–118 so that lift truck forks inserted into the slots 120, 122, lift upwardly distributing the upward force on the underside of the wide top panel section 110 of the leg-wrap 106 as best illustrated in FIGS. 41–43.

The leg-wrap corrugated pallets 104 shown in FIGS. 41–43, incorporate at least two leg-wraps 106, and preferably three leg-wraps 106, spaced apart in parallel alignment. The leg-wraps 106 may be attached to a support surface comprising sheets or panels by using holding means such as staples, rivets, tape, interlocking tabs formed therein, etc.; however the preferred attachment means is by use of a biodegradable or incineratable adhesive such as water soluble or solvent soluble glue. The leg-wraps 106 may also be fabricated having a pressure-sensitive adhesive backing 96 covered with a nonstick film, or waxed paper material 98 forming an independent leg-wrap support 106 attachable to the bottom of any type of skid or pallet 10 for additional structural support.

The multi-layer single sheet leg-wrap corrugated pallet 130 illustrated in FIG. 41 consists of a first single multi-ply corrugated support sheet 72 having a top cover sheet 72 attached to, preferably by adhesive bonding, the top surface of at least one and preferably two or more leg-wrap supports 106.

The multi-layer leg-wrap corrugated pallet illustrated in FIG. 42 utilizes a second multi-ply corrugated support sheet 136 usually rotated 90 degrees before adhesion to the top surface of the first support sheet 72 so that the second support sheet flutes 138 run perpendicular to the first support sheet flutes 74 to increase the strength of the pallet 134. The first laminate support sheet 72 is usually aligned so that the first support sheet flutes 74 run perpendicular to the leg-wrap flutes 132 to maximize the strength of the double layer leg-wrap corrugated pallet 134.

A multi-ply corrugated base sheet 76 may be attached by holding means, such as by an adhesive, to the bottom surface of the leg-wraps 106 of the single layer leg-wrap corrugated pallet 130 shown in FIG. 43 to form a corrugated leg-wrap sandwich pallet 140. The base sheet 76 is usually aligned so that the base sheet flutes 78 run perpendicular to the leg-wrap flutes 132 to maximize the strength of the leg-wrap sandwich pallet 140. Moreover, one or more base sheets 76 may be added to the double layer leg-wrap corrugated pallet 134 to provide additional strength and lateral stability to the corrugated leg-wrap pallets 104.

FIGS. 45–48 show the corrugated leg-wrap sandwich pallet 140 of FIG. 43 in more detail. The pallet 140 of the preferred embodiment includes a plurality of support members 16 as shown in FIGS. 43, 45, 47, and 48 inserted into the leg-wraps 106 with the support member flutes 46 normal to the plane of the support sheets. The support members 16 are positioned at about the distal ends and in the central portions of the leg-wrap 106 in a staggered formation so as not to interfere with the insertion of the tines of the fork lift. Reinforced support members 48, as described heretofore, are utilized in place of the support members 16 depending upon the weight of the payload to be supported by the corrugated pallet 140. The support members 16, 48 are generally adhesively secured within the leg-wrap 106 during the fabrication of the leg-wraps 106 so that the panel sections 110–118 are wrapped around the support members 16, 48 therein.

The leg-wraps 106 shown in FIGS. 43–48 feature a five sided leg-wrap 106 utilizing three narrow panel sections 114–118. This arrangement provides the maximum strength utilizing the minimum amount of material.

The leg-wraps 106 shown in FIGS. 49–54 feature a five sided leg-wrap 106 utilizing three wide panel sections 110, 111, and 112 connected to two narrow panel sections 114 and 116 positioned thereinbetween and constructed in accordance with the process described hereinbefore. This arrangement provides a double layer of corrugated material in the upper portion of the leg-wrap 106 by folding and adhesively securing wide panel section 112 with wide panel section 110. The embodiment shown herein provides additional reinforcement in the area of the leg-wrap 106 between the support sheet 72 and the tines of the fork lift.

The leg-wraps 106 shown in FIGS. 55–60 feature an eight sided leg-wrap 106 utilizing four wide panel sections 110, 111, 112, and 113 connected to four narrow panel sections 114, 115, 116, and 118 positioned thereinbetween and constructed in accordance with the process described hereinbefore. This arrangement provides a double layer of corrugated material around the entire periphery of the leg-wrap 106 by folding and adhesively securing the overlapping wide panel sections, 110, 111, 112, and 113 together; and by folding and adhesively securing the overlapping narrow panel sections 114, 115, 116, and 118 together. The embodiment shown herein provides additional structural support substantially increasing the strength of the leg-wrap corrugated pallet 104 therewith.

Figure 61:
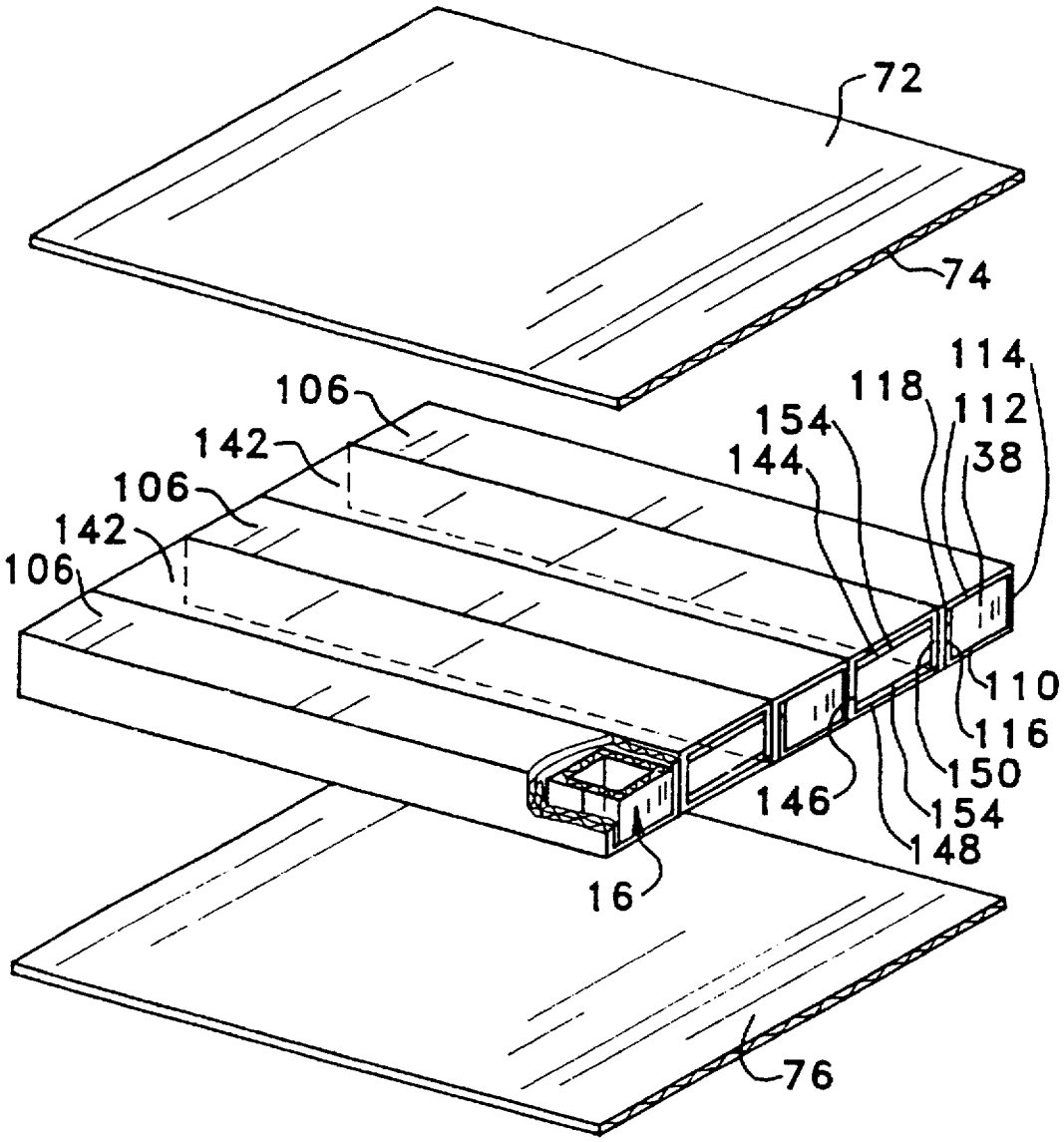
FIG. 61 is an exploded perspective view showing another preferred embodiment of a corrugated leg-wrap pallet in accordance with the present invention having a single multi-ply corrugated support sheet and single layer base sheet, a cut-away view of one of the leg-wraps showing a support member disposed therein, and support conduits disposed inbetween the leg-wrap supports and the support and base sheets.
Figure 62:
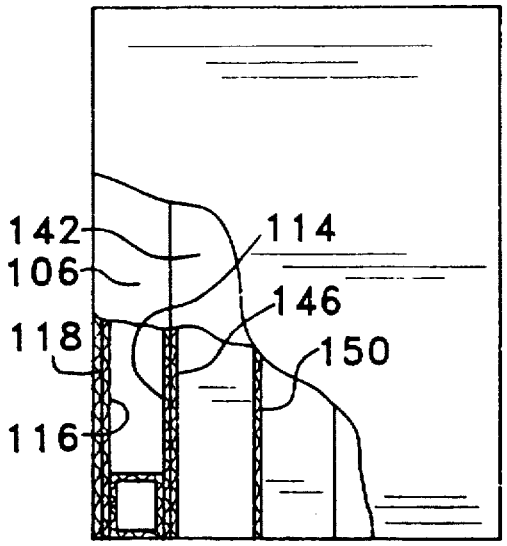
FIG. 62 is a top plan cut-away view of the corrugated pallet of FIG. 61, showing the leg-wrap, support member, and support conduit disposed therein.
Figure 63:
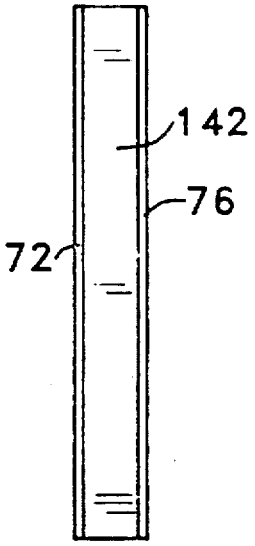
FIG. 63 is an end view of the corrugated pallet of FIG. 61, showing the smooth exterior surface of the leg-wraps.
Figure 64:
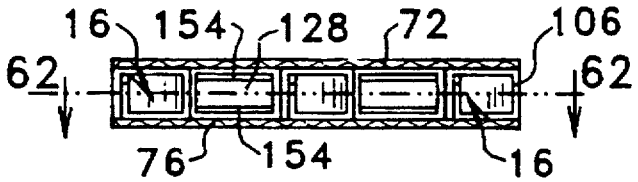
FIG. 64 is a sectional side view of FIG. 62, showing the position of the leg-wraps and support members disposed therein and the support conduits positioned between the leg-wrap supports.
Figure 65:
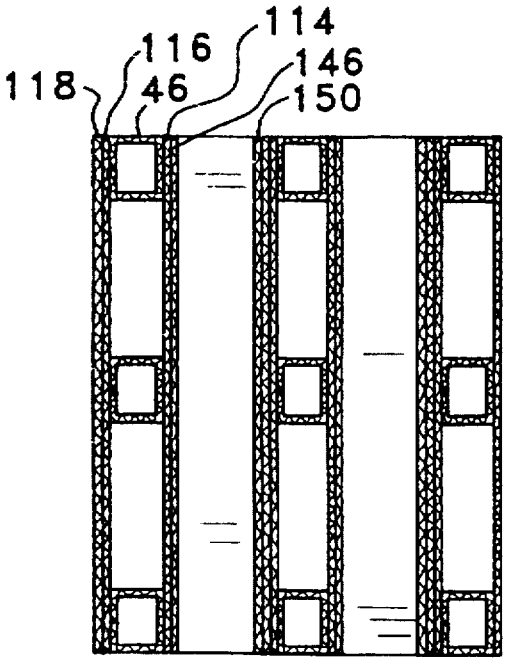
FIG. 65 is a cutaway plan top view of the corrugated pallet of FIG. 61, showing the flutes of and position of the leg-wraps support members disposed therein, and the conduit supports positioned between the leg-wrap supports.

As shown in FIGS. 61–65, a corrugated conduit support 142 is formed in the substantially the same manner as the leg-wraps 106 without the slots 120. The simplest embodiment utilizes a panel (not shown) having only four panel sections: an end wide panel section 144 connected to an inner narrow panel section 146 which is connected to a wide inner panel section 148 which is connected to an end narrow panel section 150. Folding the panel sections 144, 146, 148, and 150 around spaced apart score lines formed therein creates crease lines and forms a generally rectangular shaped corrugated conduit support 142 which is sized for insertion inbetween the leg-wraps 106 (containing support members therein) of the leg-wrap corrugated pallets 104 to provide additional support. The conduit supports 142 are secured therein utilizing a friction fit, or an adhesive may be utilized therewith. As shown in FIG. 61, the corrugated pallet 152 formed thereby does not utilize slots 120; however, the hollow conduit supports 142 provide an insertion means for the tines of a fork lift. Omission of the slots 120 further strengthens the structural strength of the corrugated pallet 152 fabricated in this manner. Of course, multiple layers of corrugated material may be used to form the conduit supports 142, such as shown in FIGS. 61–65 using additional support panels 154 in the top and bottom of the conduit supports 142 and secured therein by a pressure fit, friction fit, or fastening means such as an adhesive. The conduit supports 142 may also be fabricated with overlapping panel sections as described heretofore in the fabrication of the leg-wraps 106.

The leg-wraps 106 and/or conduit supports 142 may also be utilized with additional supporting structures having side rails or side runners 84 fabricated in combination with a support sheet 72, a single primary support sheet 14, or base sheet 76 when utilizing folding panels 90, 92 as described heretofore. The side runners 84 add substantial lateral stability and extra strength around the edge of the corrugated pallet 10 which is subjected to the greatest load strain and stress.

Figure 66:
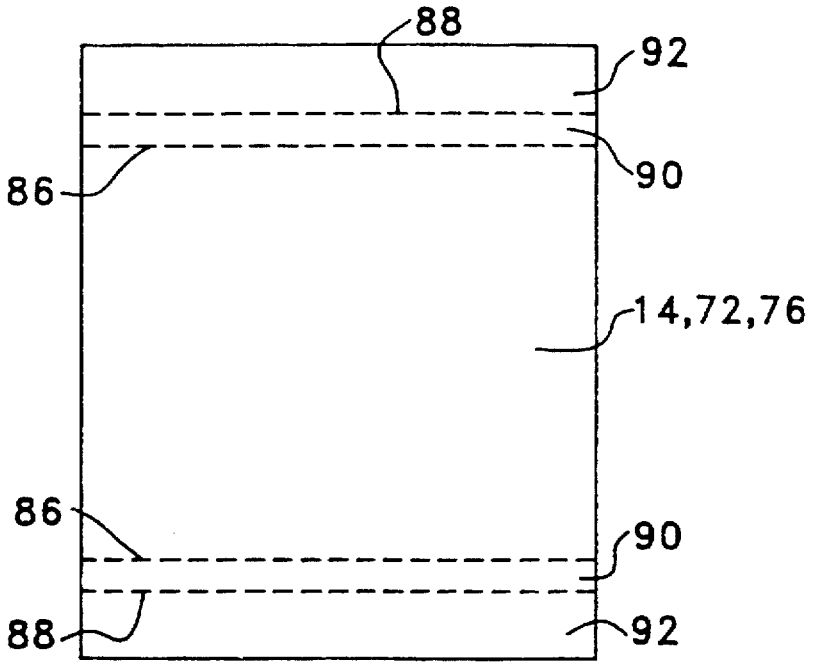
FIG. 66 is a top plan view of a corrugated support sheet having spaced apart parallel score lines formed therein and positioned near each end.
Figure 67:
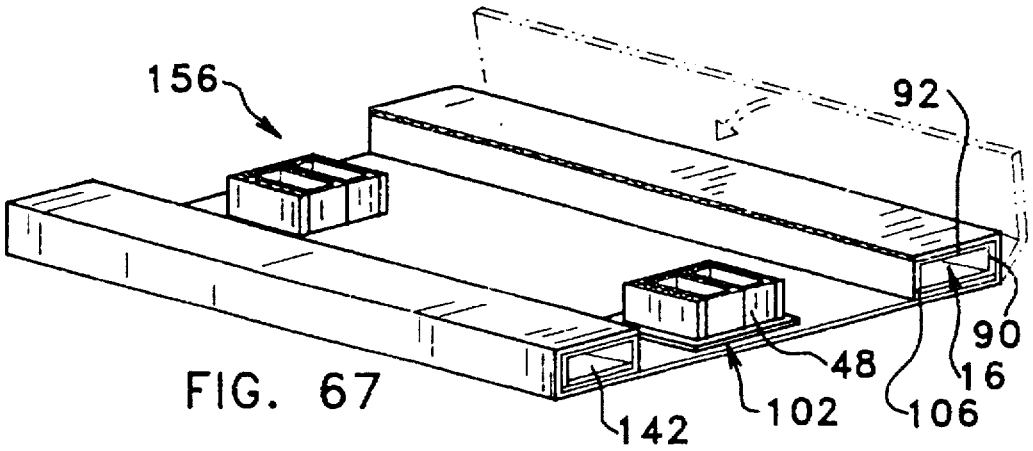
FIG. 67 is a perspective view showing the bottom portion of a leg-wrap corrugated pallet made in accordance with the present invention having base members adhesively secured along the central portion thereof and showing in phantom lines the ends of the support panel being folded inwardly around the leg-wrap supports.
Figure 68:
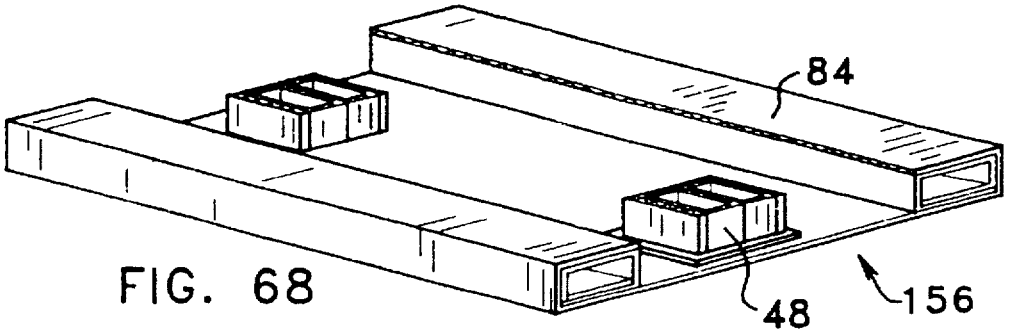
FIG. 68 is a perspective view showing the corrugated leg-wrap pallet of FIG. 67 having side rails formed around the leg-wrap supports.

As shown in the FIG. 66, the corrugated support sheet 72, 76 is perforated with a pair of spaced apart parallel score lines consisting of inner score line 86 and outer score line 88 forming an inner panel 90 and outer panel 92 on each side of the support sheet 72, 76 forming creases therein. As shown in FIGS. 67–68, leg-wraps 106 and/or conduit supports 142 are inserted and adhesively affixed to the bottom of the support sheet 72 or base sheet 76. The inner panels 90 and outer panels 92 are folded inwardly around the leg-wraps 106 or conduit supports 142 forming side rails 84 on each side of the corrugated pallet 10. It is contemplated that additional support sheets 72 and/or base sheets 76 may be used in combination with the corrugated pallet 156 having side runners 84.

As shown in FIGS. 69–78, the corrugated collapsible container pack 158 of the present invention includes an integral corrugated pallet as described heretofore. Preferably a leg wrap support pallet 130 or 134 such as is shown and described in FIGS. 41–42 and has conduits 128 to accommodate the tines of a fork lift extending through the sides of the leg wrap supports 106 as well as inbetween them. The support sheet 72, 74 of the preferred embodiment may optionally include cutaway corners 160 to provide a recess to accommodate the multiple layers of corrugated sidewall corners which must be overlapped at the corners of the collapsible container pack 158 to provide side access. The cutaway corners 160 optionally provide a means for corrugated vertical support members 162 such as shown in FIG. 75 to fit between the pallet 130 and the sidewall of the container pack 158 so that the bottom of the vertical support members 162 rests upon the tray 164 bottom surface 165.

Figures 69, 70, 71:
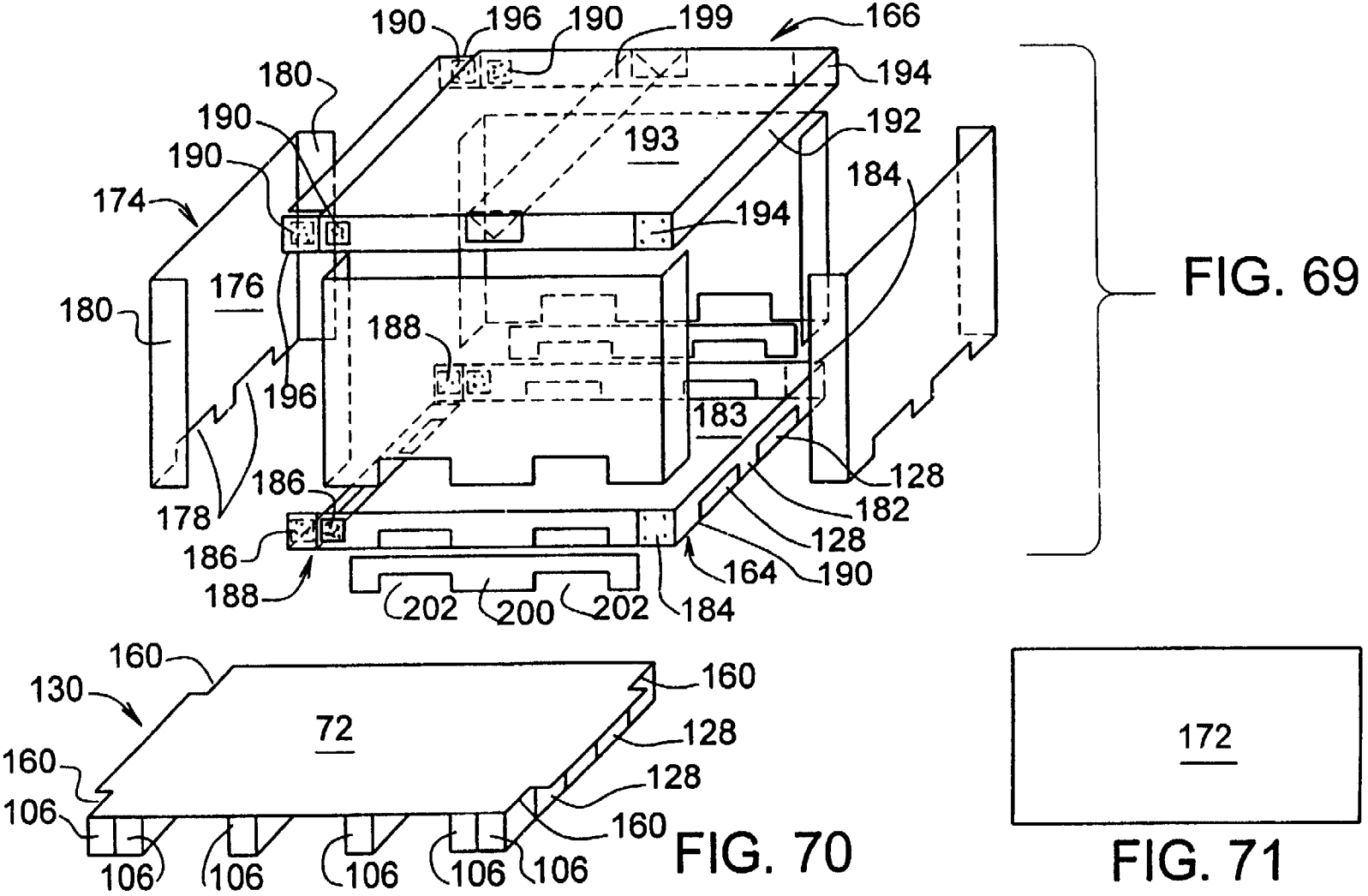
FIG. 69 is an exploded perspective view of the corrugated collapsible container pack showing the components thereof.
FIG. 70 is a perspective view of one embodiment of a corrugated pallet utilized in the corrugated collapsible container pack.
FIG. 71 is a top view of a corrugated sheet which may be utilized in the corrugated collapsible container pack.

FIG. 76 which shows a several corrugated collapsible container packs 158 in the collapsed state stacked one upon another. As shown in FIG. 76 the vertical support members 162 may rest against the tray 164 bottom 165 and support the lid 166 as best illustrated by collapsed container pack 168. An additional support sheet 172 such as shown in FIG. 71 may be placed upon the surface of sheet 72 to provide support for the vertical support members 162. The vertical support members 162 may also support the lid 166 by extending downward to rest upon the top surface of the support sheet 172 placed upon sheet 72 of the leg wrap support pallet 130 as shown in the collapsed container pack 170.

The corrugated collapsible container pack 158 may be fabricated using a single die cut sheet with score lines to form the side sections having a single joint. However, as shown in FIG. 69, the preferred embodiment includes four opposing side wall sheets 174 having vertical score lines near the outer edges. Bending the outer edges of the side wall sheets 174 inwardly forms a center panel 176 having a pair of fork lift cutouts 178 and a pair of side panels 180 which overlap.

A single corrugated sheet is used to form the bottom tray 164. The sheet has score lines extending near the outer edges, and score lines and die cuts formed in each of the corners to facilitate folding the outer edge of the sheet upward defining vertical panels 182 extending upwardly from a bottom tray floor panel 183 and attaching the corner of the vertical tray panels 182 with a means for holding such as an adhesive or staples forming permanently secured corners 184 on one end of the tray 164. Removable means of attachment such as a hook and loop fastener 186, (often sold under the tradename of VELCRO®), is used to secure the two detachable corners 186 opposite the secured corners 184 so that the tray panel 182 can be pivoted to the horizontal position providing a flat surface. The secured vertical tray panels 182 form a tray lip 188 extending around the periphery of the tray 164.

A single corrugated sheet is used to form the top lid 166. The sheet has score lines extending near the outer edges, and score lines and die cuts formed in each of the corners to facilitate folding the outer edge of the sheet downward defining vertical lid panels 192 extending downwardly from a lid center panel 193 and attaching the corner of the vertical lid panels 192 with a means for holding such as an adhesive or staples forming permanently secured corners 194 on the same end of the top lid 166. Removable means of attachment such as a hook and loop fastener 190, (often sold under the tradename of VELCRO®), is used to secure the two detachable corners 196 opposite the secured corners 194 so that the lid panel 192 can be pivoted to the horizontal position providing a flat surface. The secured vertical lid panels 192 form a lid lip 198 extending around the periphery of the tray 164. The secured corners 194 of the lid 166 are placed in vertical alignment with the secured corners 184 of the tray 164 providing four secured corners 184, 194 on one end of the container pack 158 and four detachable corners 186, 196 on the opposite end to facilitate removal of the contents of the container pack 158 without removing the top lid 166. As shown in phantom lines in FIG. 69 of the preferred embodiment, the lid 166 includes a corrugated lid support strip 199 extending across and secured to the inner surface at about the center of the lid center panel 193 and extending downwardly secured to the inner surface of the opposing vertical lid panels 92 to provide additional structural support for stacking of the full container packs 158.

The leg wrap pallet 130, 134 is set inside of the tray 164. The side panels 174 are positioned in a tray 164 between the side walls of the leg wrap pallet 130, 134 and the interior surface of the tray lip 188 so that the vertical edges of the side panels 180 of the side wall sheets 174 overlap one another. A die cut tray reinforcement sheet 200 having cutouts 202 to facilitate the tines of a fork lift is placed inbetween the interior surface of the trap lip 188 and the exterior surface of the side wall sheets 174 to provide structural support and rigidity to the structure.

Figure 79:
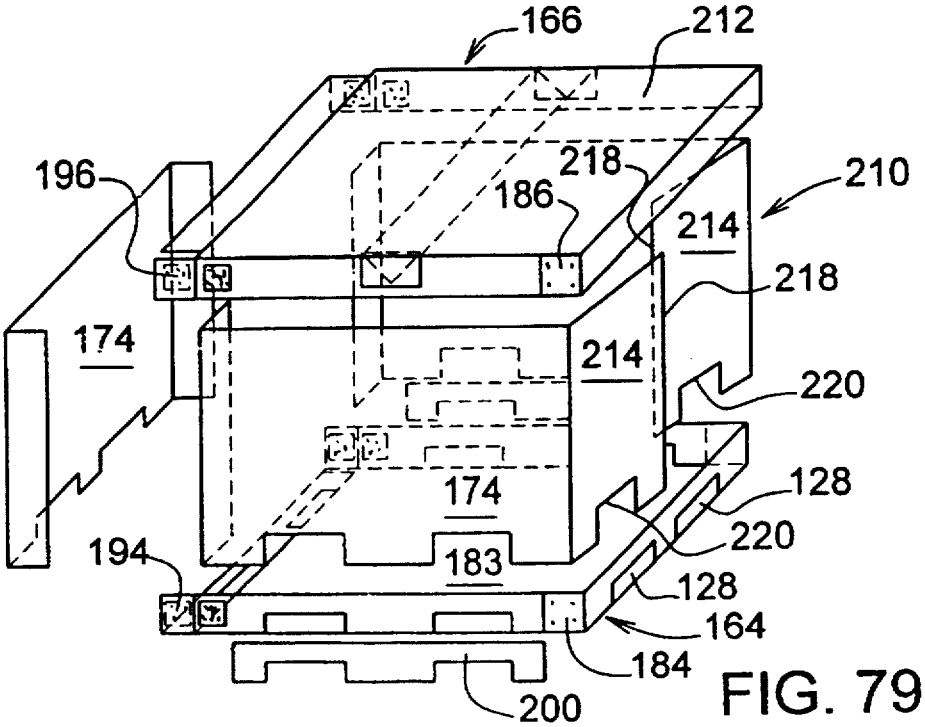
FIG. 79 is an exploded perspective view showing the components of an alternate embodiment.

FIG. 79 shows an alternate embodiment wherein only three sheets are used to provide the sidewalls of the container pack 210. One removable sidewall sheet 174 as described heretofore is used in combination with two wraparound side wall sheets 212. The wraparound sidewall sheets 212 consist of a sidewall sheet 174 having score lines to facilitate bending the sheet forming corners 216 and forming end panels 214 attached thereto or formed thereon so that the distal end vertical edges 218 of each of the wraparound sidewall sheets 212 meet in the center. Each of the end panels have a cutaway portion 220 at the bottom for alignment with the cutaways 128 formed in the leg wrap supports 106 or in alignment with the spacing between the leg wrap supports 106. Of course, it is contemplated that the single side wall sheet 174 could also be eliminated each wraparound sidewall sheet 212 could utilize a second opposing end panel 214; however, the convenience of side entry would be eliminated, and side access is an important feature of the present invention.

It is contemplated that the vertical support members 162 could be cut to a selected length so that two or more would fit end to end in the corners of the container pack 158 between the interior surface of the corner of the tray 164 and/or lid 166 and the exterior surface of the corners of the side wall sheets 174 and secured in place by a friction fit of other holding means such as an adhesive or staples; however, the additional support is usually not necessary to obtain a solid fit.

Figure 78:
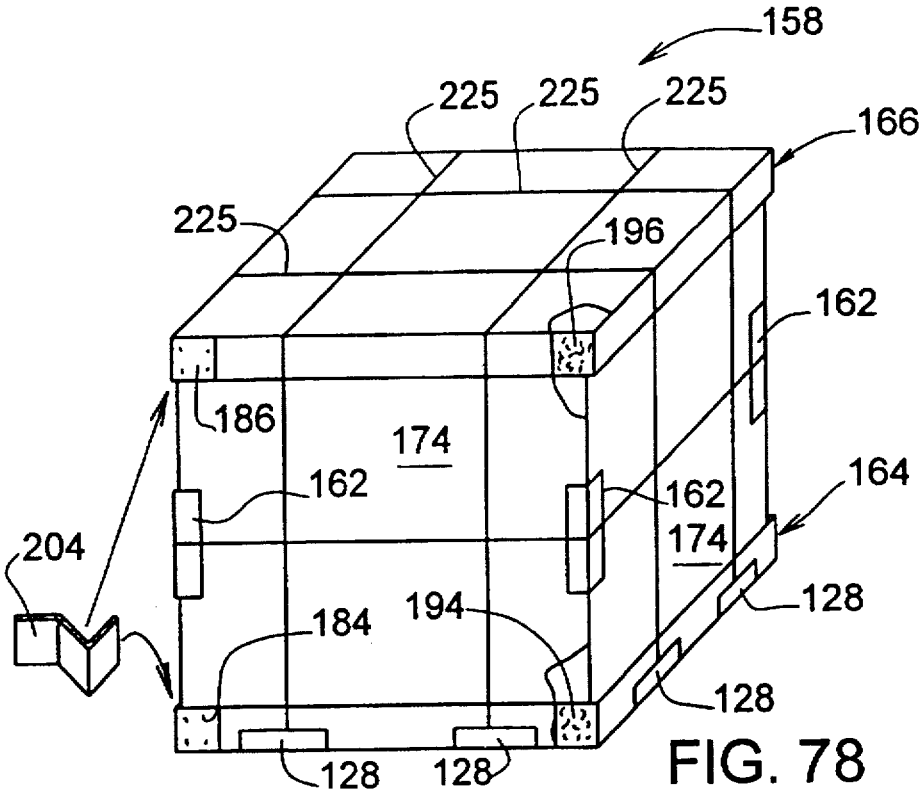
FIG. 78 is a perspective and partial cutaway view of an erected corrugated collapsible container pack showing the use of spacer sheets, the side access and vertical supports used in combination with banding.

As shown in FIGS. 74 and 78, a folded corrugated panel 204 may also be used in the corners of the container pack 158 between the interior surface of the corner of the tray 164 and/or lid 166 and the exterior surface of the corners of the side wall sheets 174 and secured in place by a friction fit of other holding means such as an adhesive or staples.

As shown in FIGS. 72 and 73, a separation panel 204 having spaced apart fingers 206 may be fabricated by using multi-ply corrugated board strips 208 having a plurality of notches cut therein at selected positions forming fingers thereinbetween. The corrugated board strips 208 shown in separation panel 204 consists of two strips secured normal to a corrugated sheet; however, a plurality of board strips 208 may be used to separate and hold material in place. The separation panel 204 may simply be placed onto the surface of the pallet 130, 134 within the tray and/or inverted and placed over the articles to be held in position within the container pack 158 and held into position by the lid 166.

A completed corrugated collapsible container pack 158 is shown erected in FIG. 77 wherein secured lid corners 194 and secured tray corners 184 are positioned on the right side and the detachable lid corners 196 and detachable tray corners 186 are positioned on the left side. The corrugated collapsible container pack 158 shown erected in FIG. 78 utilizes the vertical support members 162, which supported the lid 166 in the collapsed position, as cushion means to provide extra protection from the banding strips 225 used to hold the lid 166 to the body of the corrugated collapsible container pack 158.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims.

I claim:

1. A corrugated collapsible container pack, comprising:

a tray having a side edges bent upwardly forming four vertical tray side panels and a central floor panel, permanently attaching three of said four tray side panels forming two secured corners and removably attaching said remaining tray side panel with means for releasably securing said adjacent tray side panels forming a pair of detachable corners;

a corrugated pallet comprising at least one flat sheet and at least two leg wrap support members, each of said leg wrap support members comprising a sheet of corrugated material having a plurality of spaced apart parallel score lines formed therein, said sheet being folded inwardly forming creases along said score lines and at least five panel sections thereinbetween forming a generally rectangular shaped conduit having at least two of said panel sections overlapping and secured together with a holding means, said leg wrap support member including at least two spaced apart and aligned transverse slots formed through the sides of said support member, and said leg wrap support member including at least one support member therein, said corrugated pallet being positioned within said tray;

side wall sheets having a central panel and a pair of side panels disposed between said pallet and said tray;

a lid having side edges bent upwardly forming four vertical lid side panels and a central top panel, permanently attaching three of said four lid side panels forming two secured corners and removably attaching said remaining lid side panel with means for removably securing said adjacent lid side panels forming a pair of detachable corners, said lid being placed over the top of said side wall sheets;

a plurality of vertical support members for supporting said lid in the collapsed position in cooperative engagement with said tray, enclosing said side wall sheets therein; and said detachable tray corners and said detachable lid corners being in alignment one with the other defining means for releasing said detachable lid corners of said vertical tray panel and said vertical lid panel for removing one of said side wall sheets and providing side access to the contents stored within said corrugated collapsible container pack during the erect position without removing said lid.

* * * * *